US006969154B2

(12) United States Patent
Takeuchi et al.

(10) Patent No.: US 6,969,154 B2
(45) Date of Patent: Nov. 29, 2005

(54) INK JET RECORDING HEAD WITH MULTIPLE RECORDING ELEMENTS, ELECTRICAL CIRCUIT ELEMENTS AND PROTECTING SECTIONS

(75) Inventors: Souta Takeuchi, Kanagawa (JP); Yoshiyuki Imanaka, Kanagawa (JP); Takuya Hatsui, Kanagawa (JP); Muga Mochizuki, Kanagawa (JP); Takaaki Yamaguchi, Kanagawa (JP); Kousuke Kubo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 134 days.

(21) Appl. No.: 10/618,045

(22) Filed: Jul. 14, 2003

(65) Prior Publication Data

US 2004/0012654 A1 Jan. 22, 2004

(30) Foreign Application Priority Data

Jul. 19, 2002 (JP) ..... 2002-211740

(51) Int. Cl.[7] ..... B41J 2/05
(52) U.S. Cl. ..... 347/59; 347/64
(58) Field of Search ..... 347/20, 54, 56, 347/57–59, 63–64, 62, 65, 67

(56) References Cited

U.S. PATENT DOCUMENTS

| | | | | |
|---|---|---|---|---|
| 6,374,482 | B1 | 4/2002 | Mihara et al. | 347/61 |
| 6,402,297 | B1 | 6/2002 | Yamaguchi | 347/58 |
| 6,402,302 | B1 | 6/2002 | Ozaki et al. | 347/65 |
| 6,443,563 | B1 | 9/2002 | Saito et al. | 347/65 |
| 6,474,790 | B2 * | 11/2002 | Kaneko | 347/59 |
| 6,485,132 | B1 | 11/2002 | Hiroki et al. | 347/65 |
| 6,513,911 | B1 | 2/2003 | Ozaki et al. | 347/58 |
| 6,578,951 | B2 | 6/2003 | Ozaki et al. | 347/58 |
| 2002/0084245 | A1 | 7/2002 | Hiroki et al. | 216/27 |

FOREIGN PATENT DOCUMENTS

| | | | |
|---|---|---|---|
| JP | 2002-79672 | 3/2002 | B41J 2/05 |

* cited by examiner

*Primary Examiner*—Juanita D. Stephens
(74) *Attorney, Agent, or Firm*—Fitzpatrick, Cella, Harper & Scinto

(57) ABSTRACT

An ink jet recording head and an ink jet recording apparatus using the ink jet recording head are disclosed. The adhesion between a substrate and a discharge port forming member can be improved. In order to further reduce the size of the substrate by further optimizing the arrangement of an inspection pad, at least a recording element protecting section covers the upper part of a recording element row with a conductivity, and at least an electrical circuit element protecting section covers the upper part of an electrical circuit element row with a conductivity. An inspection electrode pad is electrically connectable with the recording element protecting section and the electrical circuit element protecting section.

14 Claims, 19 Drawing Sheets

INK JET RECORDING HEAD WITH MULTIPLE RECORDING ELEMENTS, ELECTRICAL CIRCUIT ELEMENTS AND PROTECTING SECTIONS

BACKGROUND OF THE INVENTION

1. Field of the Invention

The present invention relates to an ink jet recording head and an ink jet recording apparatus using the ink jet recording head for performing the recording operation by discharging a recording liquid onto the recording surface of a recording medium.

2. Related Background Art

In an ink jet recording head, an electrothermal energy conversion element arranged in a recording liquid chamber is heated by being supplied with an electrical pulse as a recording signal thereby to impart thermal energy to the ink. Utilizing the bubble pressure generated by the bubbling (boiling) of the recording liquid due to the phase change of the recording liquid, minute ink droplets are discharged from at least a minute discharge port thereby to perform the recording operation on a recording medium.

The electrothermal energy conversion element of this ink jet recording head is heated and the interior of the recording liquid chamber is exposed to a high temperature. Desirably, therefore, the ink having the properties thereof not changed at a high temperature is selected while at the same time covering the various elements on the substrate with a protective film to protect the electric circuit elements from thermal damage. Also, the metal surface is liable to be corroded by a water hammer when the heated bubbles are extinguished, and therefore it is desirable to provide a protective film (anti-cavitation film).

In the conventional ink jet recording head, at least an electrothermal energy conversion element and at least an electrical circuit element are mounted on a substrate, and a protective film is formed on the assembly to give a heat resistance. The resulting assembly is formed with an anti-cavitation film over the entire surface thereof, followed by forming a discharge port forming member thereon. The discharge port forming member includes a flow path wall for defining a flow path in accordance with each electrothermal energy conversion element and a discharge port communicating with an external unit from the flow path and adapted to discharge the ink. This configuration exhibits the effect of protecting the electrothermal energy conversion element and the electrical circuit element. Nevertheless, the following problem is posed.

Firstly, the ill compatibility between a tantalum (Ta) film generally used as an anti-cavitation film and the discharge port forming member made of a synthetic resin causes the problem of a low adhesion. A low adhesion between the substrate and the discharge port forming member gives rise to a solution leakage from the flow path and the displacement of the discharge port, thereby sometimes making it impossible to perform the desired recording operation.

Secondly, an inspection pad is required to check the insulation between the protective film formed under the anti-cavitation film and the electrothermal energy conversion element and the electrical circuit element, thereby undesirably increasing the size of the substrate.

In order to solve the two problems described above, Japanese Patent Application Laid-Open No. 2002-79672 discloses a recording head comprising a first metal film as an anti-cavitation film covering the upper part of a recording element and a second metal film as an anti-cavitation film covering the upper part of an electrical circuit element, where the first and second metal films are provided in the shape of a pair of combs and are arranged in opposed relation with each other. This recording head can improve the adhesion between the substrate and the discharge port forming member due to a reduced ratio which the anti-cavitation film represents of the substrate. Further, the provision of an inspection pad on each of the first and second metal films described above makes it possible to inspect the protective film for a defect without increasing the substrate size.

However, the recording head disclosed in the patent publication described above comprises an inspection electrode pad for each of the first and second metal films, with the result that the substrate size is increased proportionately. To reduce the size of the substrate, therefore, the arrangement of the inspection pad is required to be more optimized.

SUMMARY OF THE INVENTION

An object of the present invention is to provide an ink jet recording head and an ink jet recording apparatus using the ink jet recording head, in which the adhesion between a substrate and a discharge port forming member can be improved and the arrangement of an inspection pad can be optimized more thereby to reduce the substrate size further.

Another object of the invention is to provide an ink jet recording head and an ink jet recording apparatus using the ink jet recording head, the ink jet recording head comprising a substrate, a plurality of recording elements for generating the discharge energy for discharging ink droplets of a recording liquid from at least a discharge port, the recording elements forming a recording element row on the substrate, a plurality of electrical circuit elements arranged in a row adjacently to the recording element row on the substrate for driving the recording elements, at least a conductive belt-like recording element protecting section for covering the upper part of the recording element row, at least a conductive belt-like electrical circuit element protecting section electrically connected with the recording element protecting section for covering the upper part of the electrical circuit element row, and an inspection electrode pad adapted to be electrically connected to the recording element protecting section and the electrical circuit element protecting section.

Still another object of the invention is to provide an ink jet recording head and an ink jet recording apparatus using the ink jet recording head, the ink jet recording head comprising a substrate, at least a first ink supply port provided on the substrate, a plurality of recording elements forming a first recording element row arranged in a row on each of the two sides of the first ink supply port on the substrate for generating the discharge energy for discharging ink droplets of a recording liquid, a plurality of electrical circuit elements forming a first electrical circuit element row arranged in a row outside the first ink supply port with respect to the first recording element row for driving the recording elements, at least a conductive belt-like first recording element protecting section for covering the upper part of the first recording element row, at least a conductive belt-like first electrical circuit element protecting section electrically connected with the first recording element protecting section for covering the upper part of the first electrical circuit element row, at least a second ink supply port formed on the substrate, a plurality of recording elements forming a second recording element row arranged in a row on each of the two sides of the second ink supply port on the substrate for generating the discharge energy to discharge ink droplets of the recording liquid from at least a discharge port, a plurality of electrical circuit elements forming a second electrical circuit element row arranged in a row outside the second ink supply port with respect to the second recording element row, at least a conductive belt-like second recording element protecting section for covering the upper part of the second recording element row, at least a conductive belt-like second electrical circuit element protecting section electrically connected with the second recording element protecting section for covering the upper part of the second electrical circuit element row, a conducting section for electrically connecting the first electrical circuit element protecting section and the second electrical circuit element protecting section to each other, and an inspection electrode pad adapted to be electrically connected to the conducting section.

BRIEF DESCRIPTION OF DRAWINGS

FIGS. 1A and 1B are diagrams showing a configuration of a recording head cartridge using a recording head according to the invention, in which FIG. 1A is a perspective view, and FIG. 1B is an exploded perspective view in FIG. 1A.

DETAILED DESCRIPTION OF THE PREFERRED EMBODIMENTS

Embodiments of the invention is explained below with reference to the drawings.

FIGS. 1 to 6 are diagrams for explaining the configuration of and the relation between a head cartridge, a recording head and an ink tank embodying or suitably used for the invention. With reference to these diagrams, each component element is explained below.

Figure 1B:
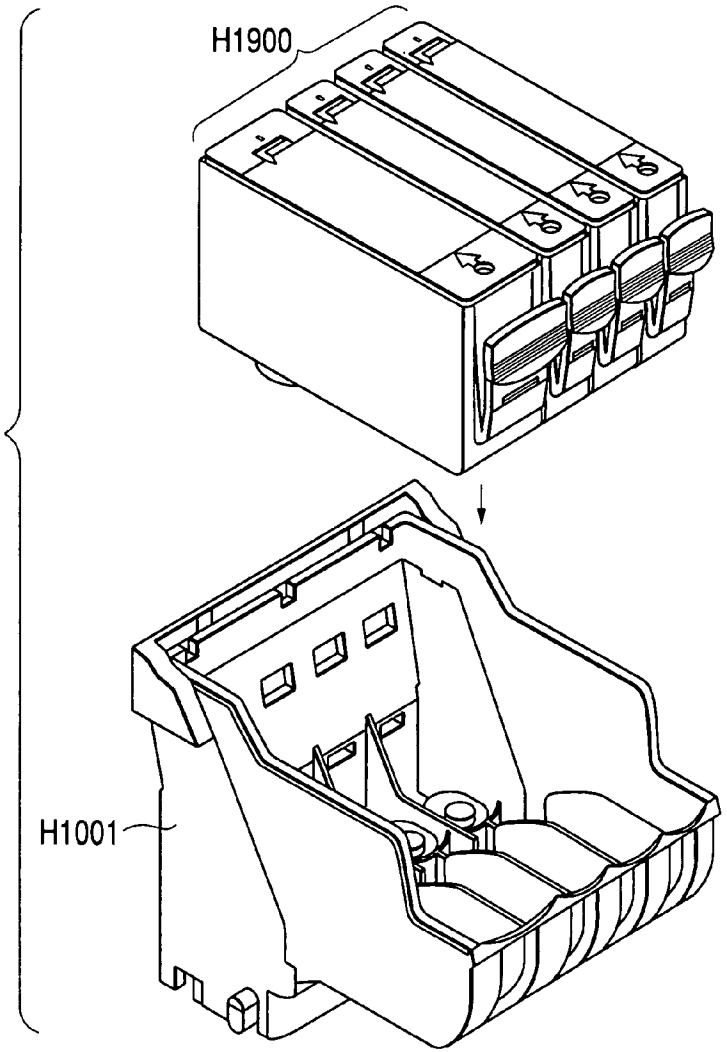
Figure 1A:
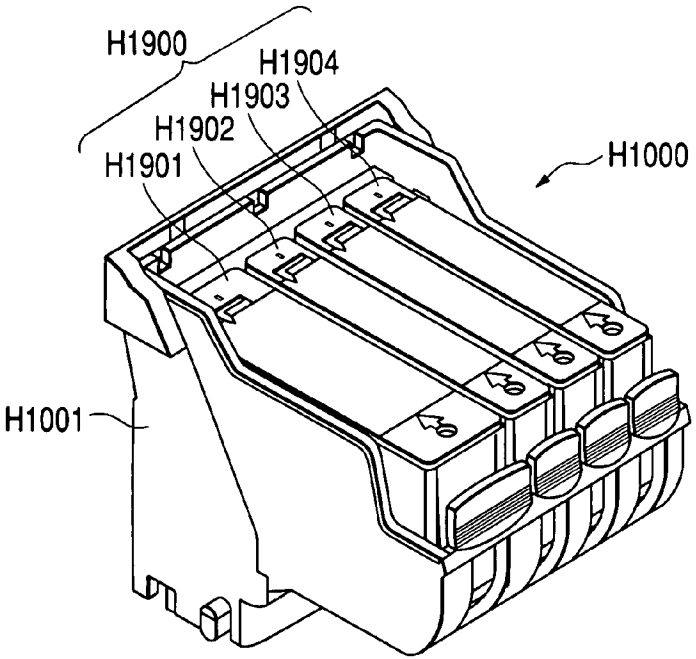

An ink jet recording head H1001 according to this embodiment, as shown in the perspective views of FIGS. 1A and B, is a component part of a recording head cartridge H1000. This recording head cartridge H1000 includes the recording head H1001 and ink tanks H1900 (H1901, H1902, H1903, H1904) removably mounted on the recording head H1001. The recording head H1001 discharges the ink (recording liquid) supplied from each of the ink tanks H1900, by way of at least a discharge port thereof in accordance with the recording information.

This recording head cartridge H1000 is fixedly supported by an electrical contact and positioning means of a carriage (not shown) mounted on the ink jet recording apparatus proper on the one hand and removable from the carriage on the other hand. The ink tank H1901 is for black ink, the ink tank H1902 for cyan ink, the ink tank H1903 for magenta ink, and the ink tank H1904 for yellow ink. In this way, the ink tanks H1901 to H1904 are mounted on the side of the seal rubbers H1800 (FIG. 3) removably from the recording head H1001 and replaceably independently of each other. Thus, the running cost of printing on the ink jet recording apparatus can be reduced.

Each component part of the recording head H1001 is sequentially explained in more detail.

(1) Recording Head

The recording head H1001 is of bubble-jet side shooter type for performing the recording operation using an electrothermal energy conversion element (recording element) for generating the thermal energy to generate the film boiling of the ink in accordance with an electrical signal.

Figure 2:
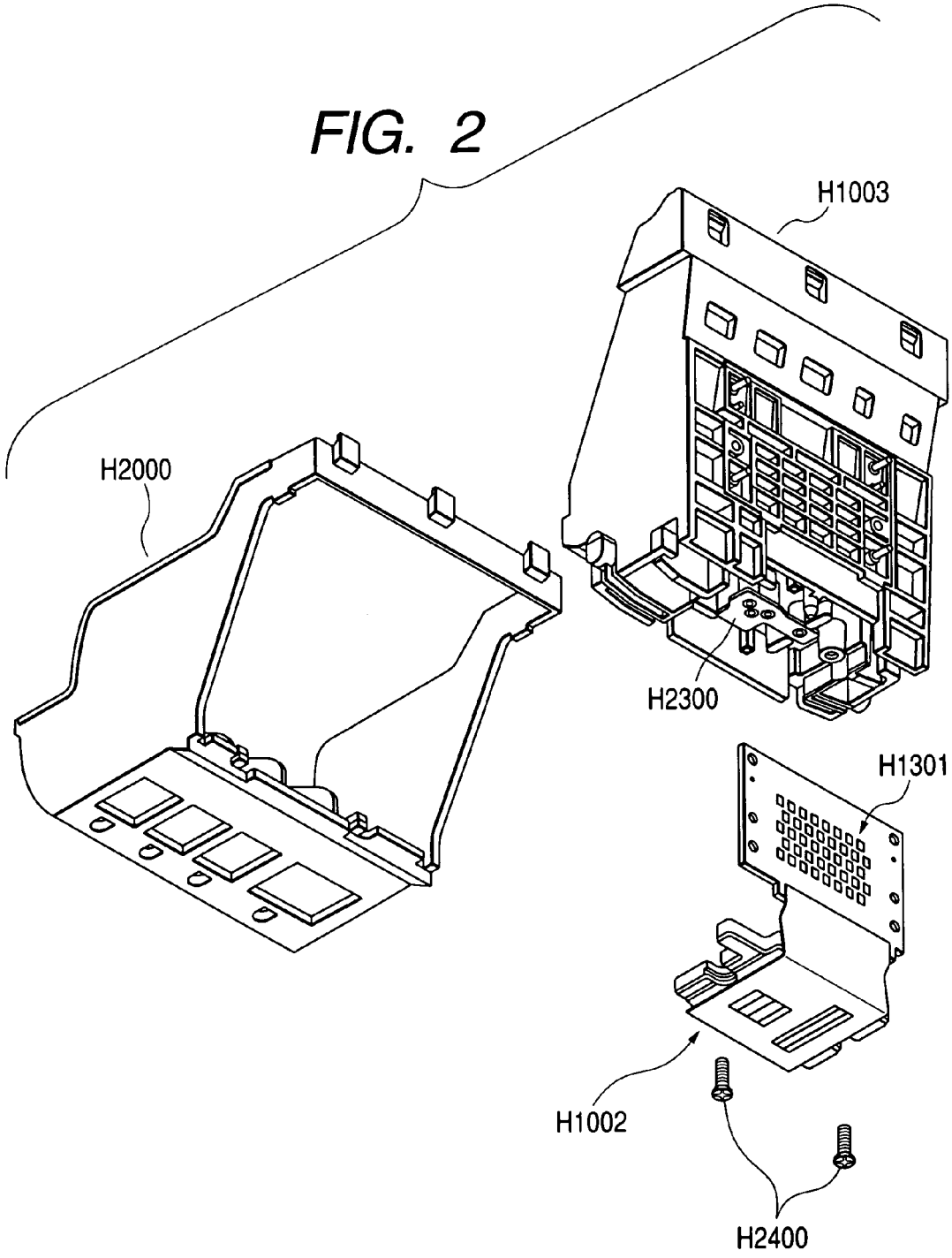
FIG. 2 is an exploded perspective view showing a configuration of the recording head of FIGS. 1A and 1B.

The recording head H1001, as shown in the exploded perspective view of FIG. 2, includes a recording element unit H1002, an ink supply unit (recording liquid supply means) H1003 and a tank holder H2000.

Figure 3:
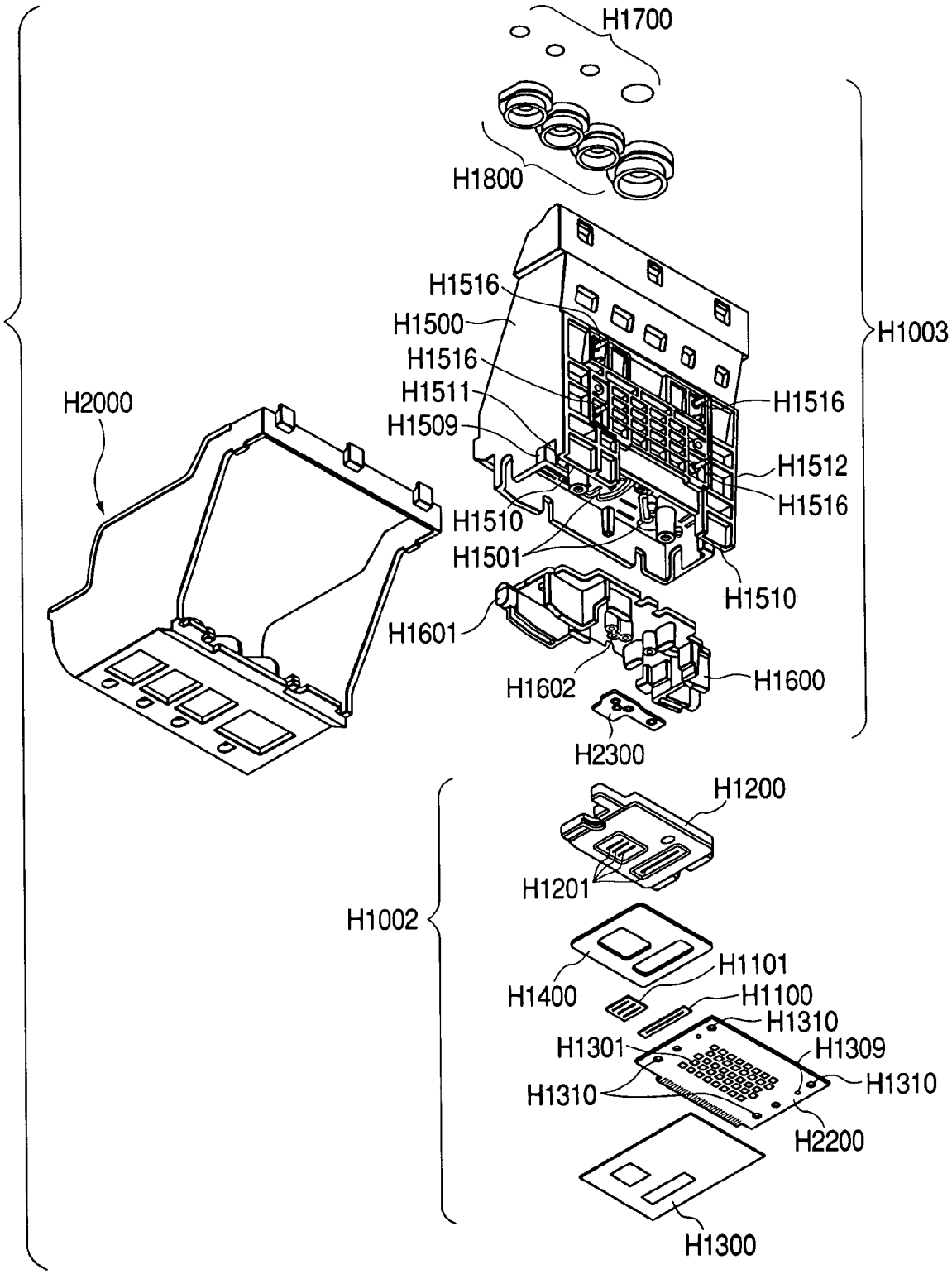
FIG. 3 is an exploded perspective view showing the recording head of FIG. 2 in more detail.

The recording element unit H1002, as shown in the exploded perspective view of FIG. 3, includes a first recording element substrate H1100, a second recording element substrate H1101, a first plate (first support member) H1200, an electrical wiring tape (flexible wiring substrate) H1300, an electrical contact substrate H2200 and a second plate (second support member) H1400. Also, the ink supply unit H1003 includes an ink supply member H1500, a flow path forming member H1600, a joint rubber H2300, a filter H1700 and a seal rubber H1800.

(1-1) Recording Element Unit

Figure 4:
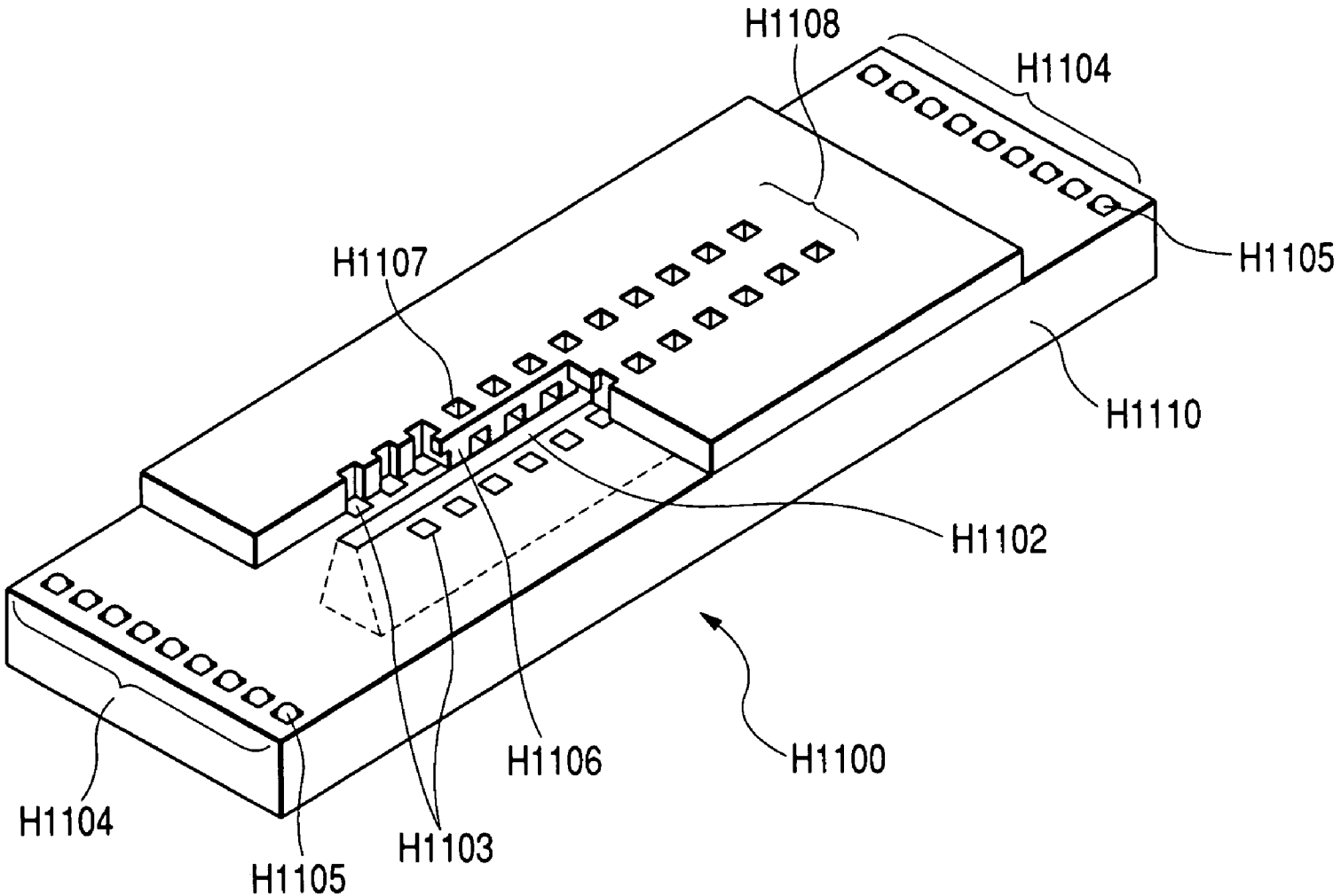
FIG. 4 is a partly cutaway perspective view for explaining the configuration of the first recording element substrate shown in FIG. 3.

The first recording element substrate H1100, as shown in the exploded perspective view of FIG. 4, is formed by the film forming technique, on one surface of a Si substrate H1110 having a thickness of 0.5 mm to 1 mm, with a plurality of electrothermal energy conversion elements (recording elements) H1103 for discharging the ink, an electrical wiring of Al or the like (not shown) for supplying power to each electrothermal energy conversion element H1103. A plurality of ink flow paths and a plurality of discharge ports H1107 corresponding to the electrothermal energy conversion elements H1103 are formed by the photolithography technique on the one hand and ink supply ports H1102 for supplying the ink to a plurality of the ink flow paths are formed by being opened to the opposite side (reverse surface).

As shown in the exploded perspective view of FIG. 3, the first recording element substrate H1100 is bonded fixedly on the first plate H1200 where the ink supply port H1102 is formed. Further, the first plate H1200 is fixedly bonded with the second plate H1400 having an opening. Through this second plate H1400, the electrical wiring tape H1300 is held and connected electrically to the first recording element substrate H1100. The electrical wiring tape H1300 is for applying an electrical signal to the first recording element substrate H1100 for discharging the ink, and includes an electrical wiring corresponding to the first recording element substrate H1100 and an external signal input terminal H1301 located in the electrical wiring section for receiving an electrical signal from the ink jet recording apparatus proper. This external signal input terminal H1301 is set in position fixedly on the back side of the ink supply member H1500.

The ink supply port H1102 is formed in the shape of a rectangularly grooved through hole by a method such as anisotropic etching or sand blasting utilizing the crystalline orientation of Si.

The first recording element substrate H1100, as shown in the exploded perspective view of FIG. 4, has the electrothermal energy conversion elements H1103 arranged in staggered fashion each in a row on the two sides of the ink supply port H1102. The electrothermal energy conversion elements H1103 and the electrical wiring of Al or the like for supplying electric power to the electrothermal energy conversion elements H1103 are formed by the film forming technique. Further, electrodes H1104 for supplying electric power to the electric wiring are arranged along the outer periphery in the direction perpendicular to the electrothermal energy conversion elements H1103. The electrodes H1104 are each formed with a bump H1105 of Au or the like by the ultrasonic welding process. The surface of the Si substrate H1110 is formed with an ink flow path wall H1106 for forming an ink flow path corresponding to the electrothermal conversion elements H1103 and a discharge port forming member having discharge ports H1107 with a resin material by the photolithography technique thereby to form a group of the discharge ports H1108. In view of the fact that the discharge ports H1107 are provided in opposed relation with the electrothermal energy conversion elements H1103, the ink supplied from the ink supply ports H1102 is discharged from the discharge ports H1107 by the bubbles generated by the heating operation of the electrothermal energy conversion elements H1103.

Figure 5:
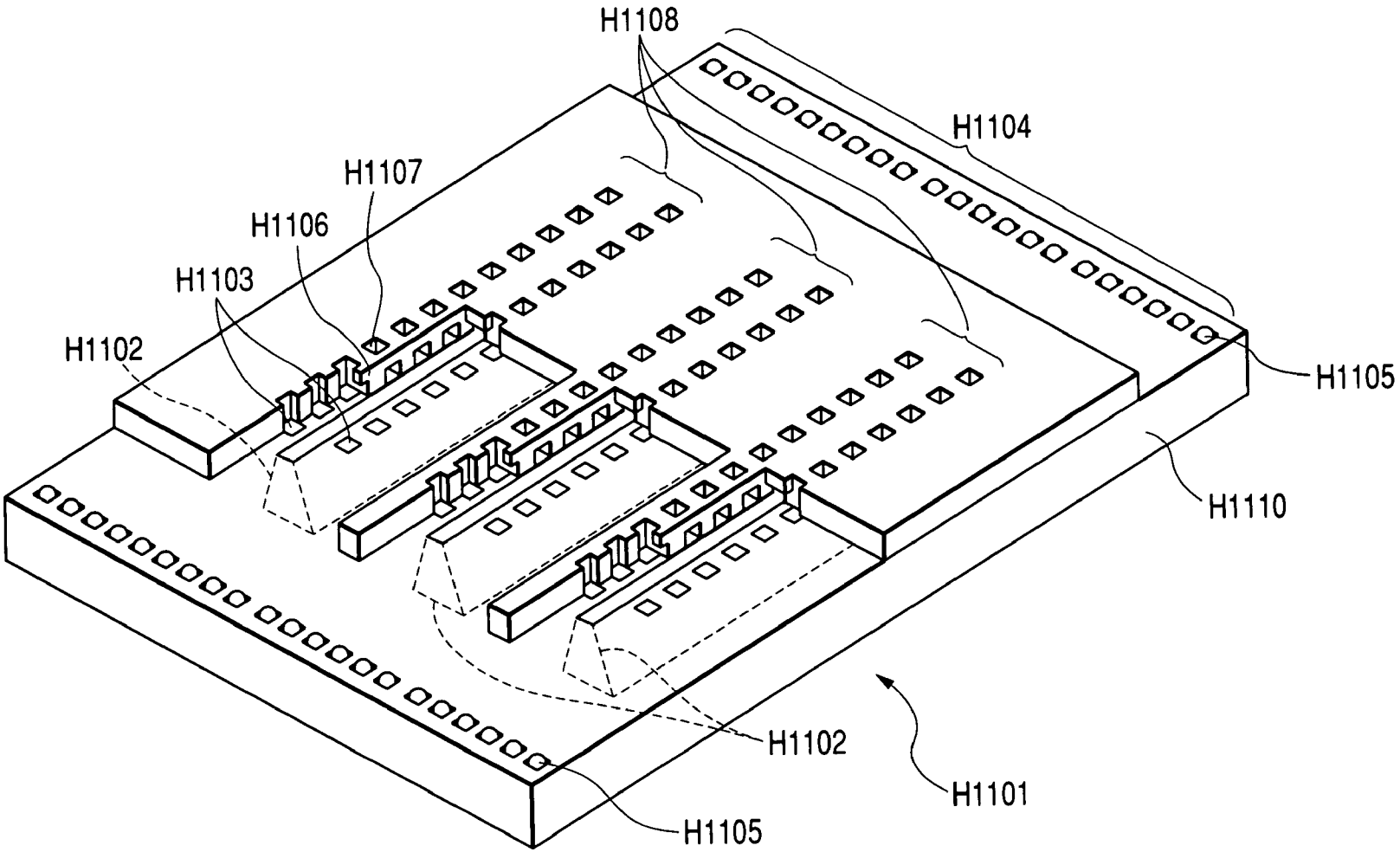
FIG. 5 is a partly cutaway perspective view for explaining the configuration of the second recording element substrate shown in FIG. 3.

The second recording element substrate H1101, as shown in the exploded perspective view of FIG. 5, is a recording element substrate for discharging the ink of three colors and has three ink supply ports H1102 in parallel. The electrothermal energy conversion elements H1103 and the discharge ports H1107 are formed on both sides of the ink supply ports H1102. Like in the first recording element substrate H1100, the Si substrate H1110 is formed with the ink supply ports H1102, the electrothermal energy conversion elements H1103, the electrical wiring and the electrodes H1104. On this assembly, the discharge port forming member having the discharge ports H1107 and the ink flow path are formed of a resin material by photolithography. Like in the first recording element substrate H1100, the electrodes H1104 for supplying electric power to the electric wiring are formed with bumps H1105 of Au or the like.

The first plate H1200 is formed of, for example, an alumina ($Al_2O_3$) material having a thickness of 0.5 mm to 10 mm. However, this first plate H1200 may be formed of any other materials having a coefficient of linear expansion equivalent to that of the material of the first recording element substrate H1100 and a heat conductivity at least equal to that of the material of the first recording element substrate H1100. Also, the first plate H1200 is formed with ink pass holes H1201 for supplying the black ink to the first recording element substrate H1100 on the one hand and supplying the cyan, magenta and yellow ink to the second recording element substrate H1101 on the other. The ink supply ports H1102 of the first and second recording element substrates H1100, H1101 correspond to the ink pass holes H1201, respectively, of the first plate H1200, while the first and second recording element substrates H1100, H1101 are fixedly bonded with high positional accuracy on the first plate H1200.

Figure 9:
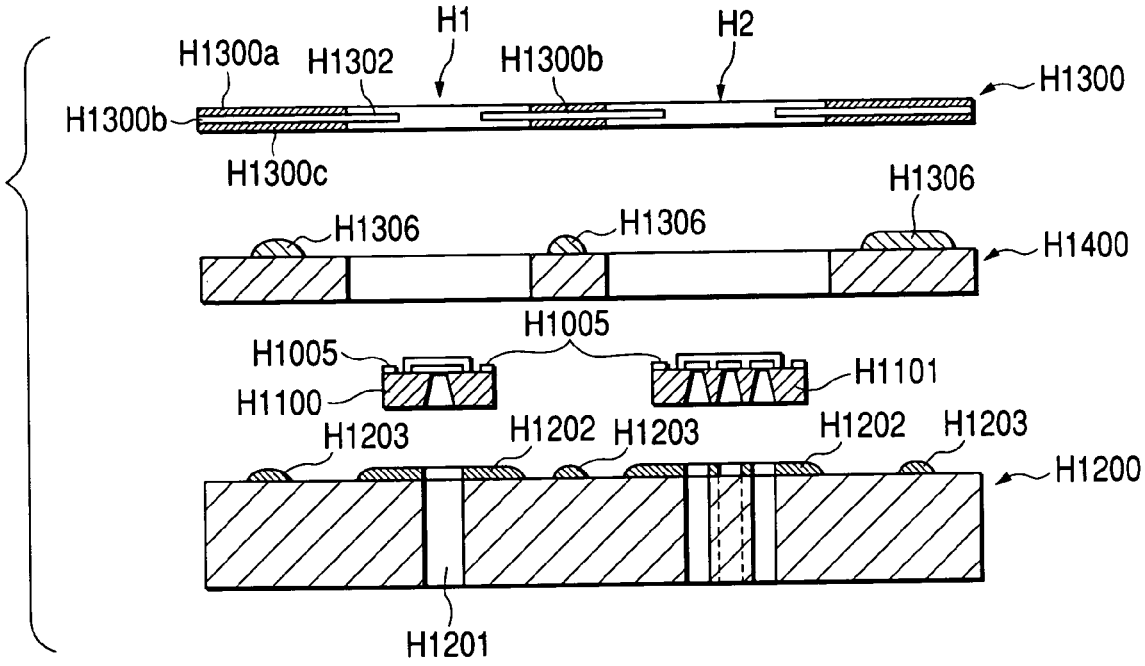
FIG. 9 is a sectional view schematically showing the main parts of the recording element unit according to a first embodiment of the invention.

The electrical wiring tape H1300 is means for applying an electrical signal to discharge the ink to the first recording element substrate H1100 and the second recording element substrate H1101. This electrical wiring tape H1300, as shown in FIG. 9, includes device holes (openings) H1, H2 for building in the first and second recording element substrates H1100, H1101, respectively, electrode leads H1302 corresponding to the electrodes H1104 of the first and second recording element substrates H1100, H1101, respectively, an electrical terminal unit located at the end portion of the electrical wiring tape H1300 for electrically connecting the electrical contact substrate H2200 having an external signal input terminal H1301 for receiving an electrical signal from the ink jet recording apparatus proper. The electrical terminal unit and the electrode leads H1302 are connected to each other with a continuous wiring pattern of a copper foil. The electrical wiring tape H1300 has a double-layer structure, for example, and the surface layer thereof is formed of a flexible wiring substrate covered by a resist film. In this case, the reverse surface (outer surface) of the external signal input terminal H1301 is bonded with a reinforcing plate to secure an improved flatness. The reinforcing plate is made of a heat resistant material such as glass epoxy or aluminum having a thickness of, say, 0.5 mm to 2 mm.

The electrical wiring tape H1300 is electrically connected with the first recording element substrate H1100 and the second recording element substrate H1101, respectively. The connecting method consists in, for example, the thermal ultrasonic welding process for electrically coupling the bumps H1105 on the electrodes H1104 of the recording element substrates and the electrode lead H1302 of the electrical wiring tape H1300 to each other.

The second plate H1400 is a single tabular member having a thickness of 0.5 mm to 1 mm and is formed of a metal material such as Al or SUS or a ceramic such as alumina. The second plate H1400, however, is not limited to these materials, but may be formed of any other materials having a coefficient of linear expansion equivalent to that of the recording element substrates H1100, H1101 and the first plate H1200 and a heat conductivity at least equal to that of the recording element substrates H1100, H1101 and the first plate H1200.

Figure 10:
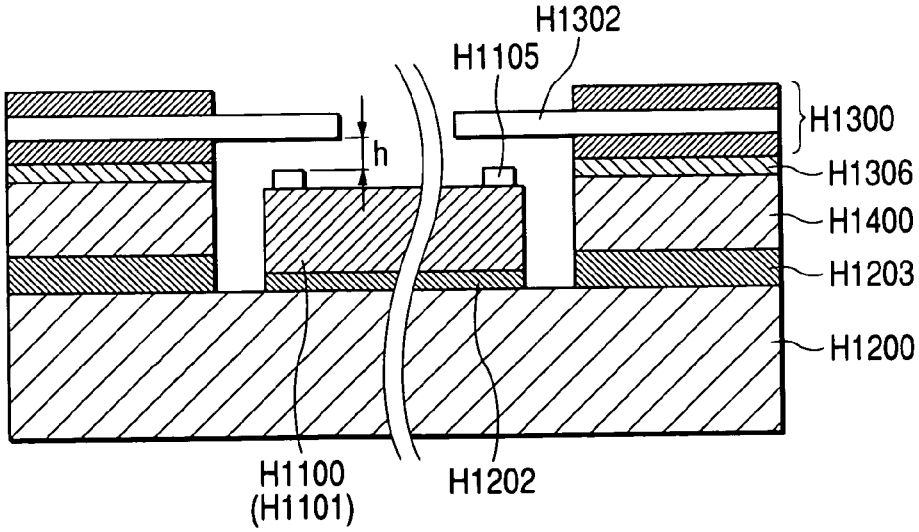
FIG. 10 is an enlarged sectional view showing the main parts of the recording element unit according to the first embodiment.

The second plate H1400 is formed in such a shape as to have a larger opening than the outer dimensions of the first recording element substrate H1100 and the second recording element substrate H1101 fixedly bonded with the first plate H1200. Also, as shown in FIG. 10, the second plate H1400 is bonded by second adhesive layers H1203 to the first plate H1200 and the reverse surface of the electrical wiring tape H1300 is fixedly bonded by third adhesive layers H1306 in such a manner that the electrical wiring tape H1300 can be electrically connected in planar fashion to the first recording element substrate H1100 and the second recording element substrate H1101.

The electrically connected portion of the first recording element substrate H1100 and the second recording element substrate H1101 with the electrical wiring tape H1300 is sealed with a first sealing agent (not shown) and a second sealing agent (not shown), so that the electrically connected portion is protected against an external shock and a corrosion by the ink. The first sealing agent is used mainly for sealing the reverse surface of the connecting section between the electrode lead H1302 of the electrical wiring tape and the bumps H1105 of the recording element substrates and the outer peripheral portion of the recording element substrates. The second sealing agent is used for sealing the obverse surface of the connecting section.

An end portion of the electrical wiring tape H1300 is electrically connected, by thermal bonding using an anisotropic conductive film or the like, with an electrical contact substrate H2200 having an external signal input terminal H1301 for receiving an electrical signal from the ink jet recording apparatus proper.

The electrical wiring tape H1300 is bonded to the second plate H1400 while at the same time being bent along one side of the first plate H1200 and the second plate H1400 and bonded to the side surface of the first plate H1200 by the third adhesive layer H1306. The second adhesive forming the second adhesive layer H1203, which is desirably low in viscosity and thus can form a thin second adhesive layer H1203 on the contact surface, has an ink resistance. Also, the third adhesive layer H1306 is a thermoset adhesive layer made of an epoxy resin, for example, as a main component having a thickness of not more than 100 $\mu$m.

(1-2) Ink Supply Unit (Recording Liquid Supply Means)

The ink supply member H1500 is formed by resin molding, for example. The resin material is preferably mixed with 5 to 40% of a glass filler to improve the profile toughness.

Figure 6:
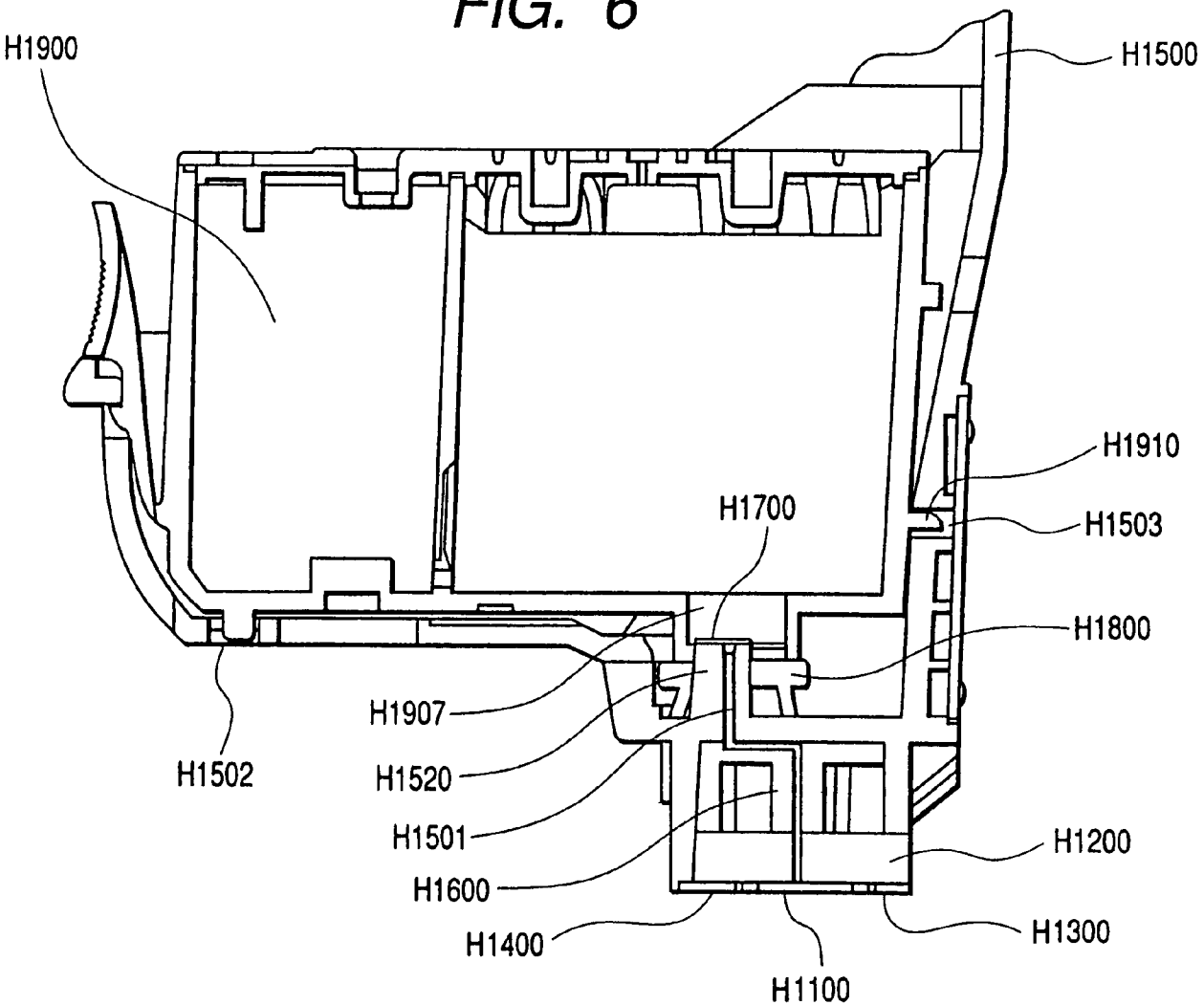
FIG. 6 is a sectional view showing the main parts of the recording head cartridge of FIGS. 1A and 1B.

As shown in FIGS. 3 and 6, the ink supply member H1500 removably holding the ink tank H1900 is a component part of the ink supply unit H1003 for leading the ink to the recording element unit H1002 from the ink tank H1900. By ultrasonic welding of the flow path forming member H1600, an ink flow path H1501 is formed from the ink tank H1900 to the first plate H1200. Also, a joint unit H1520 engaging the ink tank H1900 is coupled by welding with a filter H1700 to keep off external dust, and also has mounted thereon a seal rubber H1800 to prevent the evaporation of the ink from the joint unit H1520.

The ink supply member H1500 has the function of holding the ink tank H1900 removably and has a first hole H1503 adapted to engage a second claw H1910 of the ink tank H1900.

The ink supply member H1500 includes a mounting guide H1601 for guiding the recording head cartridge H1000 to the carriage mounting position of the ink jet recording apparatus proper, an engaging section for fixedly mounting the recording head cartridge H1000 on the carriage by a head set lever, an X-direction (carriage scanning direction) butting section H1509 for setting the carriage in a predetermined position, a Y-direction (recording medium conveying direction) butting section H1510 and a Z-direction (ink discharge direction) butting section H1511. Also, the ink supply member H1500 includes a terminal fixing unit H1512 for fixing the electrical contact substrate H2200 of the recording element unit H1002 in position. A plurality of ribs are arranged on and around the terminal fixing unit H1512 to improve the rigidity of the surface having the terminal fixing unit H1512.

(1-3) Coupling Between Recording Head Unit and Ink Supply Unit

As shown in FIGS. 2 and 3, the recording head H1001 is completed by coupling the recording element unit H1002 to the ink supply unit H1003 and further coupling it with a tank holder H2000 in the following manner.

In order to establish communication between the ink pass hole of the recording element unit H1002 (the ink pass hole H1201 of the first plate H1200) and the ink pass hole of the ink supply unit H1003 (the ink pass hole H1602 of the flow path forming member H1600) in such a manner as not to leak the ink, the respective members are fixed by a screw H2400 through the joint rubber H2300. At the same time, the recording element unit H1002 is accurately fixed in position with respect to the reference positions in X, Y and Z directions of the ink supply unit.

Figure 7:
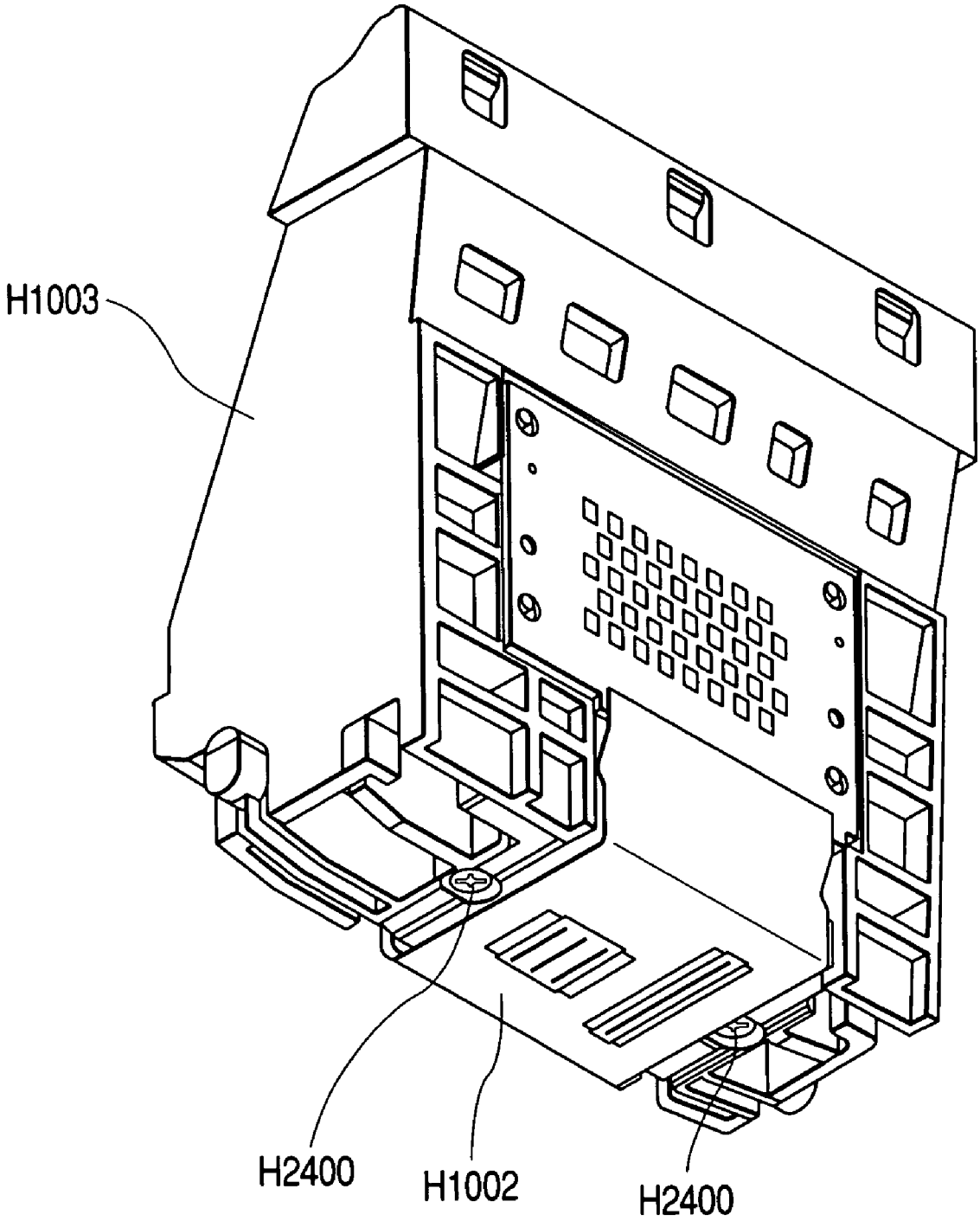
FIG. 7 is a perspective view showing an assembly formed of the recording element unit and the ink supply port shown in FIGS. 2 and 3.

The electrical contact substrate H2200 of the recording element unit H1002 is set in position fixedly on one side surface of the ink supply member H1500 by terminal positioning pins H1516 (at four points) and the terminal positioning holes H1310 (at four points). A method of fixing consists in caulking the terminal positioning pins H1516 of the ink supply member H1500. Nevertheless, another fixing means may be used for fixing. A completion drawing is shown in FIG. 7.

Figure 8:
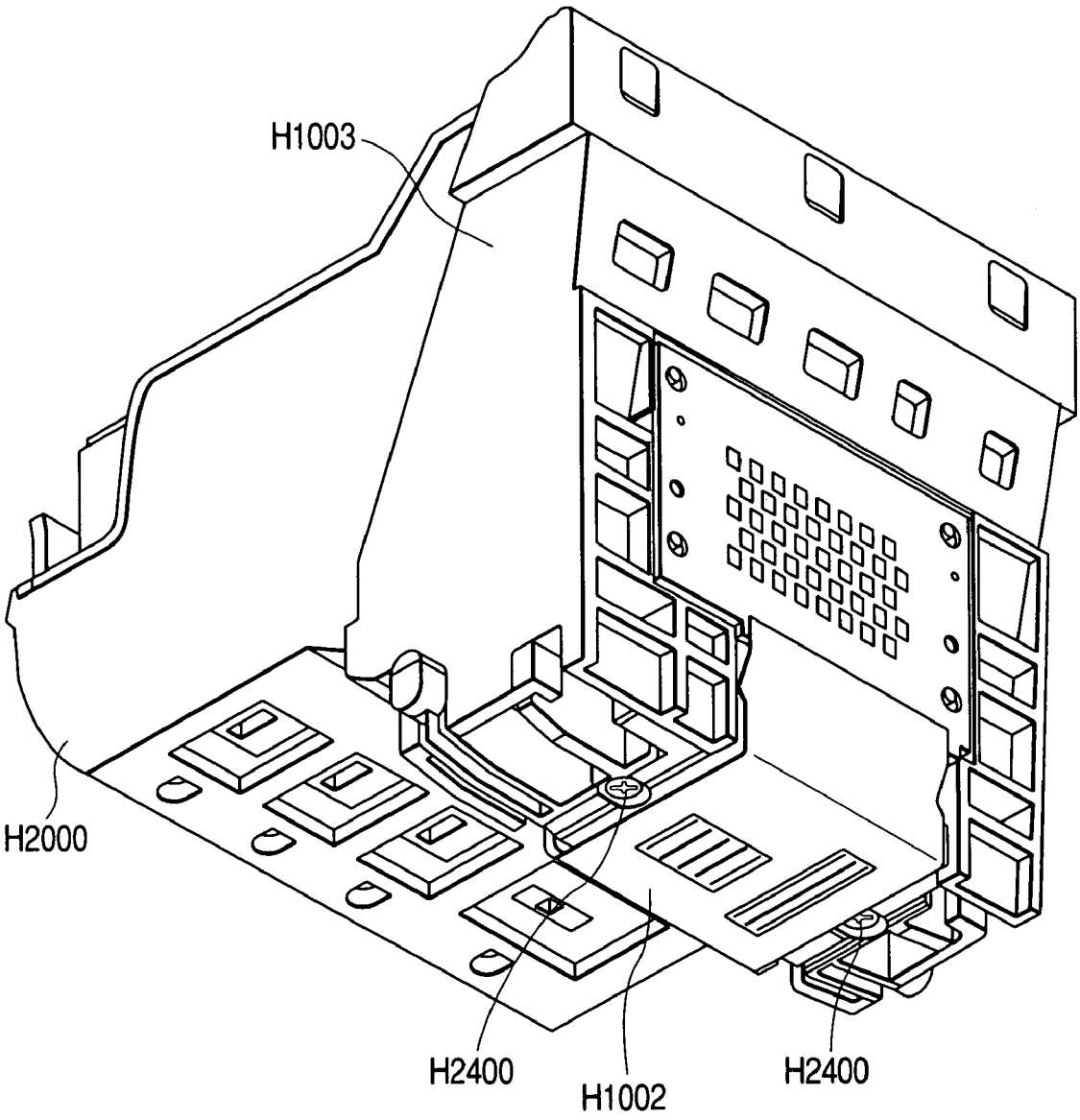
FIG. 8 is a perspective view showing the bottom side of the recording head of FIGS. 1A and 1B.

A recording head H1001 is completed by fitting and coupling the connecting hole and the connecting section of the ink supply member H1500 on the tank holder H2000. Specifically, the recording head H1001 is configured by coupling, with an adhesive or the like, the ink supply unit H1003 including the ink supply member H1500, the flow path forming member H1600, the filter H1700 and the seal rubber H1800, the recording element unit H1002 including the recording element substrates H1100, H1101, the first plate H1200, the wiring substrate H1300 and the second plate H1400, and the tank holder H2000 to each other. A completion drawing is shown in FIG. 8.

(2) Recording Head Cartridge

FIGS. 1A and B are diagrams for explaining the manner in which the recording head H1001 and the ink tanks H1901 to H1904 forming the recording head cartridge H1000 are mounted. The ink tanks H1901 to H1904 contain the inks of the corresponding colors. Also, as shown in FIG. 6, each ink tank is formed with an ink pass hole H1907 for supplying the ink from within the ink tank to the recording head H1001.

Once the ink tank H1901 is mounted on the recording head H1001, for example, the ink pass hole H1907 of the ink tank H1901 is brought into close contact with the filter H1700 arranged on the joint unit H1520 of the recording head H1001. Thus, the black ink in the ink tank H1901 is supplied to the first recording element substrate H1100 from the ink pass hole H1907 through the ink flow path H1501 of the recording head H1001 and the first plate H1200.

The ink then is supplied to the bubble chamber including the electrothermal energy conversion elements H1103 and the discharge ports H1107, and discharged toward the recording paper forming a recording medium by the thermal energy applied by the ink to the electrothermal energy conversion elements H1103.

<Embodiment 1>

A first embodiment of this invention is explained below with reference to FIGS. 9 to 18.

FIG. 9 is an exploded sectional view schematically showing the main parts of the recording element unit H1002, and FIG. 10 is a sectional view schematically showing the main parts of the recording element unit H1002.

As shown in FIG. 9, the bonded portion and the neighboring portion thereof of the electrical wiring tape H1300 has a three-layer structure including a polyimide base film H1300*a* on the surface side, an intermediate copper foil H1300*b* and a solder resist H1300*c* on the back side. This electrical wiring tape H1300 includes a device hole (opening) H1 into which the first recording element substrate H1100 is inserted, and a device hole (opening) H2 into which the second recording element substrate H1101 is inserted. Electrode leads (inner leads) connected to the bumps H1005 of the first and second recording element substrates H1100, H1101 are plated with gold and exposed.

A method of fabricating the recording element unit H1002 according to this embodiment is explained, step by step, with reference to FIGS. 9 and 10.

First, the second plate H1400 is bonded to the first plate H1200 by second adhesive layers H1203. Next, first adhesive layers H1202 for bonding the first and second recording element substrates H1100, H1101 to the first plate H1200 are formed by being coated on the first plate H1200. After that, the first and second recording element substrates H1100, H1101 are fixedly pressed in relative positions along the wiring plane of a plurality of electrothermal energy conversion elements H1103 or the discharge ports H1107 for discharging the recording liquid.

After that, third adhesive layers H1306 for fixedly bonding the reverse surface of the electrical wiring tape H1300 are formed by being coated on the second plate H1400. Then, the electrodes H1104 of the first and second recording element substrates H1100, H1101 are set in position with the electrode lead H1302 of the electrical wiring tape H1300 and fixedly pressed. After that, the bumps H1105 on the electrodes 1104 of the first and second recording element substrates H1100, H1101 and the electrode leads H1302 of the electrical wiring tape H1300 are electrically coupled with each other, at each one point thereof, by the thermal ultrasonic welding process.

Further, the joints between the bumps H1105 on the electrodes H1104 of the first and second recording element substrates H1100, H1101 and the electrode lead H1302 of the electrical wiring tape H1300 are sealed with resin to prevent the shorting which otherwise might be caused by the ink, etc.

Figure 11:
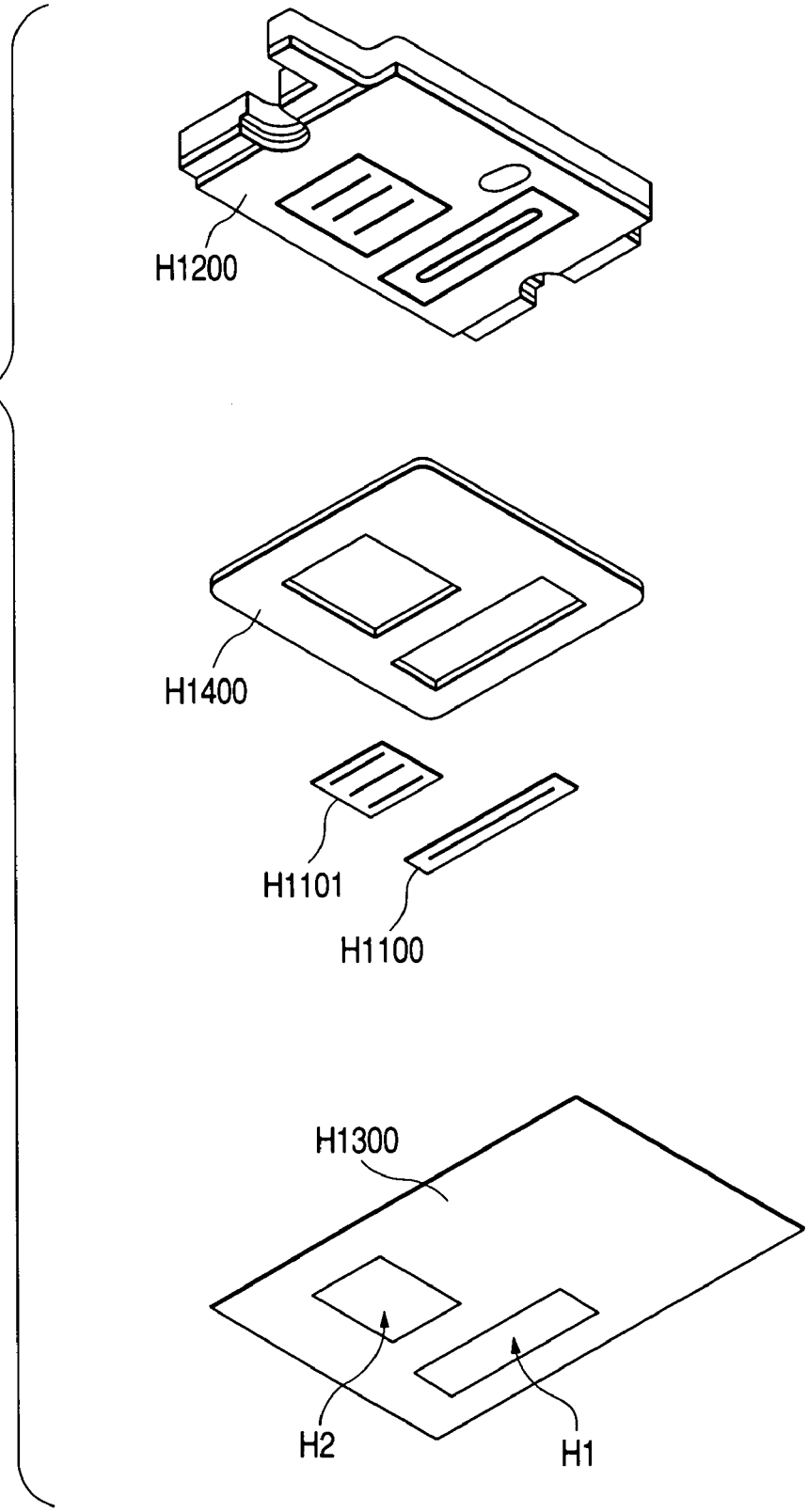
FIG. 11 is an enlarged exploded perspective view showing the main parts of the recording element unit according to the first embodiment.

FIG. 11 is an enlarged exploded view and a sectional view of the first and second plates H1200, H1400, the first and second recording element substrates H1100, H1101 and the electrical wiring tape H1300 shown in FIG. 3. With reference to FIGS. 9 to 11, the configuration of this embodiment is explained in more detail.

In this embodiment, the first plate H1200 and the second plate H1400 are made of alumina. The electrical wiring tape (flexible printed board) H1300, as described above, has a structure of three layers including a base film, a copper foil wiring and a solder resist, and is provided with the device holes H1, H2 thereby exposing the gold-plated electrode leads H1302.

The second plate H1400 according to this embodiment is a single tabular member provided with two holes into which the first and second recording element substrates H1100, H1101, respectively, are to be inserted. The second plate H1400 is fixedly bonded to the first plate H1200. Also, the electrical wiring tape H1300 is bonded to the second plate H1400 by the third adhesive layers H1306, over the entire surface thereof except for the device holes H1, H2 formed to expose the first and second recording element substrates H1100, H1101.

According to this embodiment, the black head and the color head are both integrally assembled on the same wiring board, and therefore the correction of the landing points of the ink from the two heads is not required.

In the recording head H1001 having the aforementioned configuration according to this embodiment, the black ink is discharged using the first recording element substrate H1100, while the color ink for the three colors including cyan, magenta and yellow is discharged using the second recording element substrate H1101.

The nozzle of the first recording element substrate H1100 is so configured that the discharge ports H1107 are arranged in staggered fashion on the two sides of the ink supply port H1102 each at the rate of 300 dpi. The electrothermal energy conversion elements (recording element) H1103 of 600 dpi are arranged at positions in opposed relation with the respective discharge ports H1107. The second recording element substrate H1101 has three ink supply ports H1102 for each substrate. The discharge ports H1107 for cyan, magenta and yellow are arranged in staggered fashion at intervals of 600 dpi on each side, and the electrothermal energy conversion elements (recording elements) H1103 are arranged at intervals of 1200 dpi at positions in opposed relation with the corresponding discharge ports H1107, respectively. The recording head H1001 according to this embodiment has the two recording element substrates H1100, H1101, for black and color, mounted on the single first plate H1200 in order to secure an arrangement of the two recording element substrates H1100, H1101 with a very high accuracy. Also, the electrical contact substrate H2200 and the electrical wiring tape H1300 for supplying power and data from the ink jet recording apparatus proper are shared by the two recording element substrates H1100, H1101 to reduce the number of parts and the cost at the same time.

The recording head H1001 according to this embodiment is mounted on the carriage of the ink jet recording apparatus proper. An electrical contact on the carriage and the electrical contact substrate H2200 arranged on the recording head H1001 are electrically connected to each other.

A detailed configuration of the two recording element substrates H1100, H1101 constituting the main feature of the invention is explained.

The configuration of the first recording element substrate H1100 is explained with reference to FIG. 12.

Figure 12:
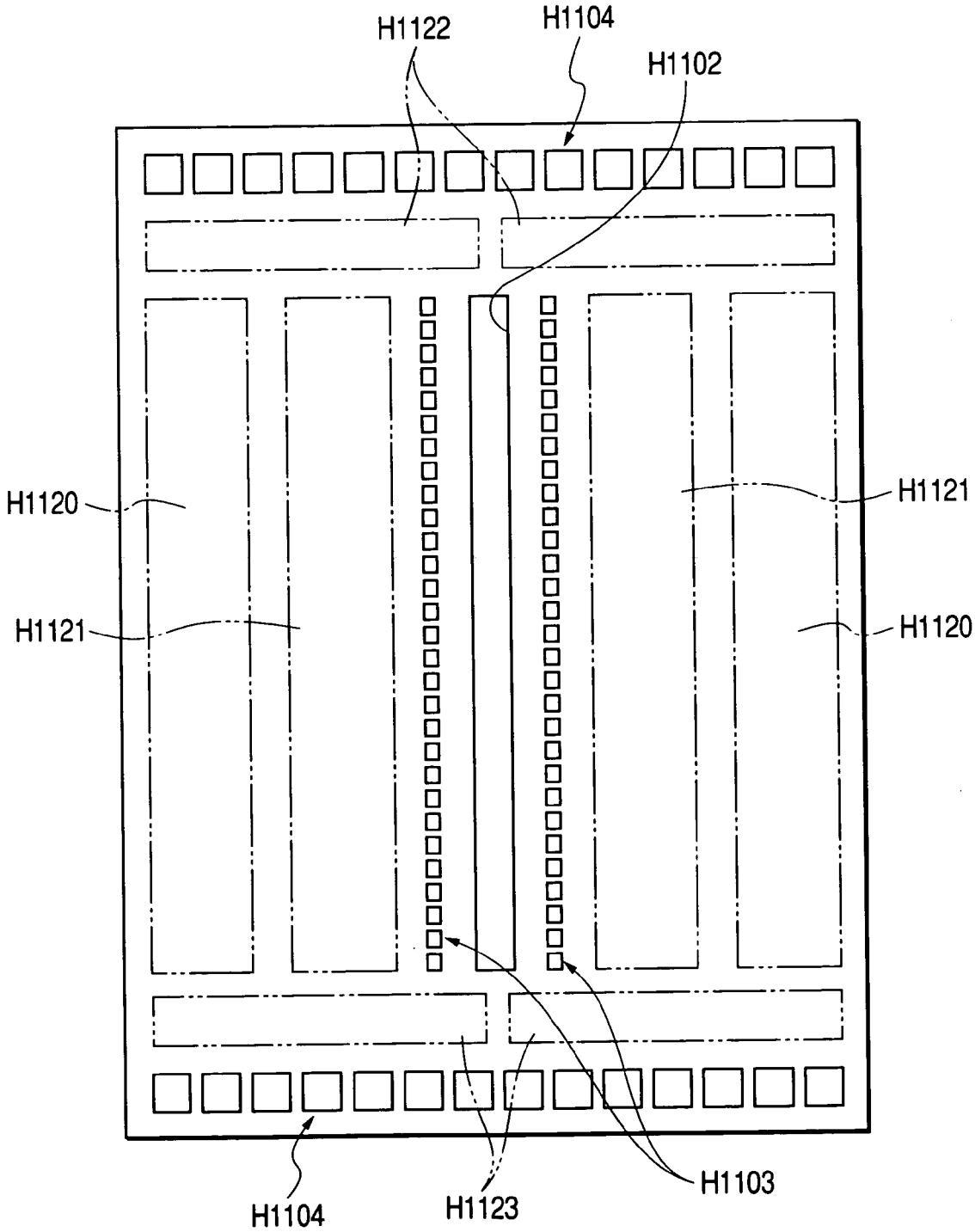
FIG. 12 is a plan view schematically showing the first recording element substrate according to the first embodiment.
Figure 13:
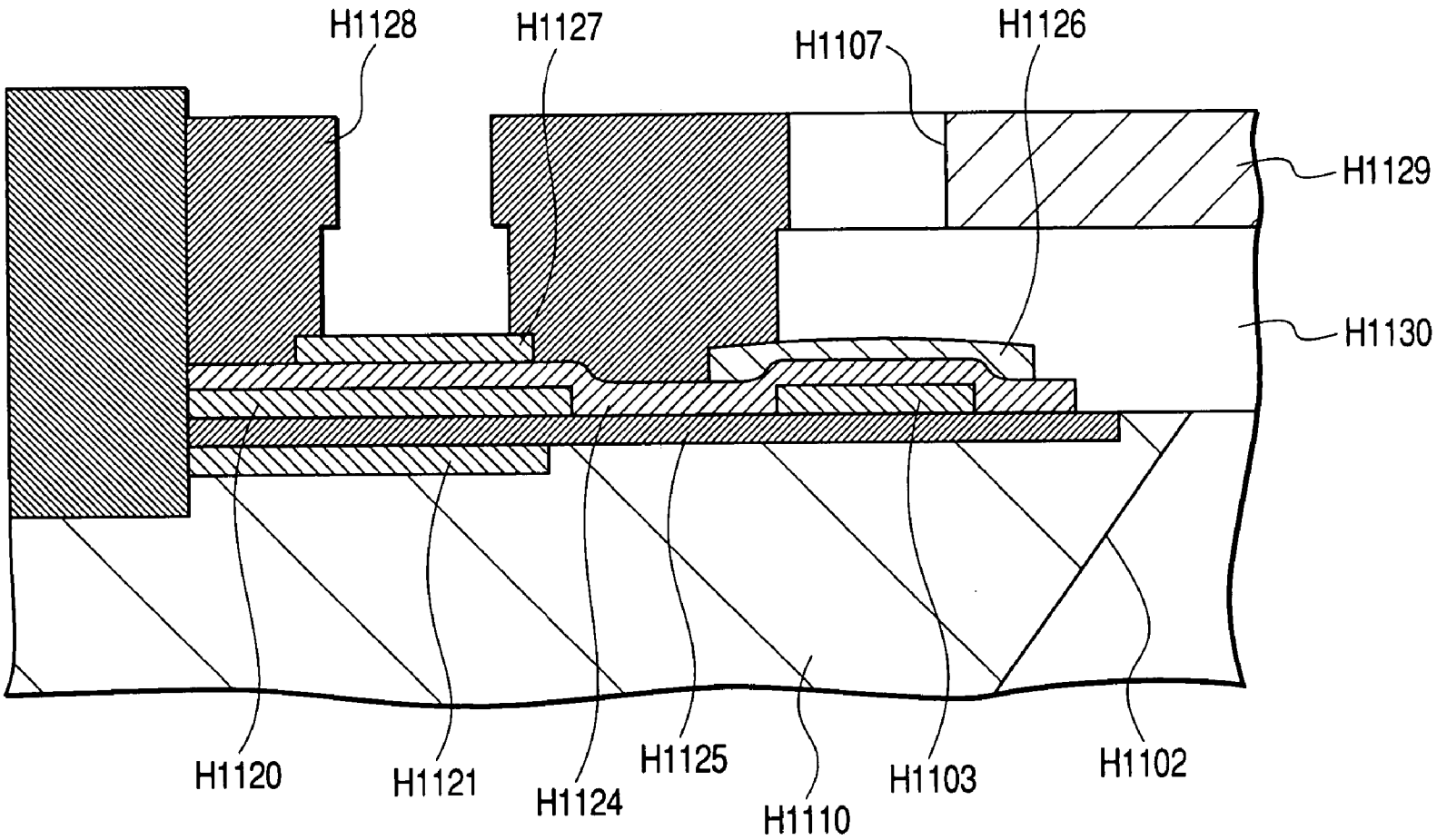
FIG. 13 is a sectional view schematically showing the first recording element substrate according to the first embodiment.
Figure 14:
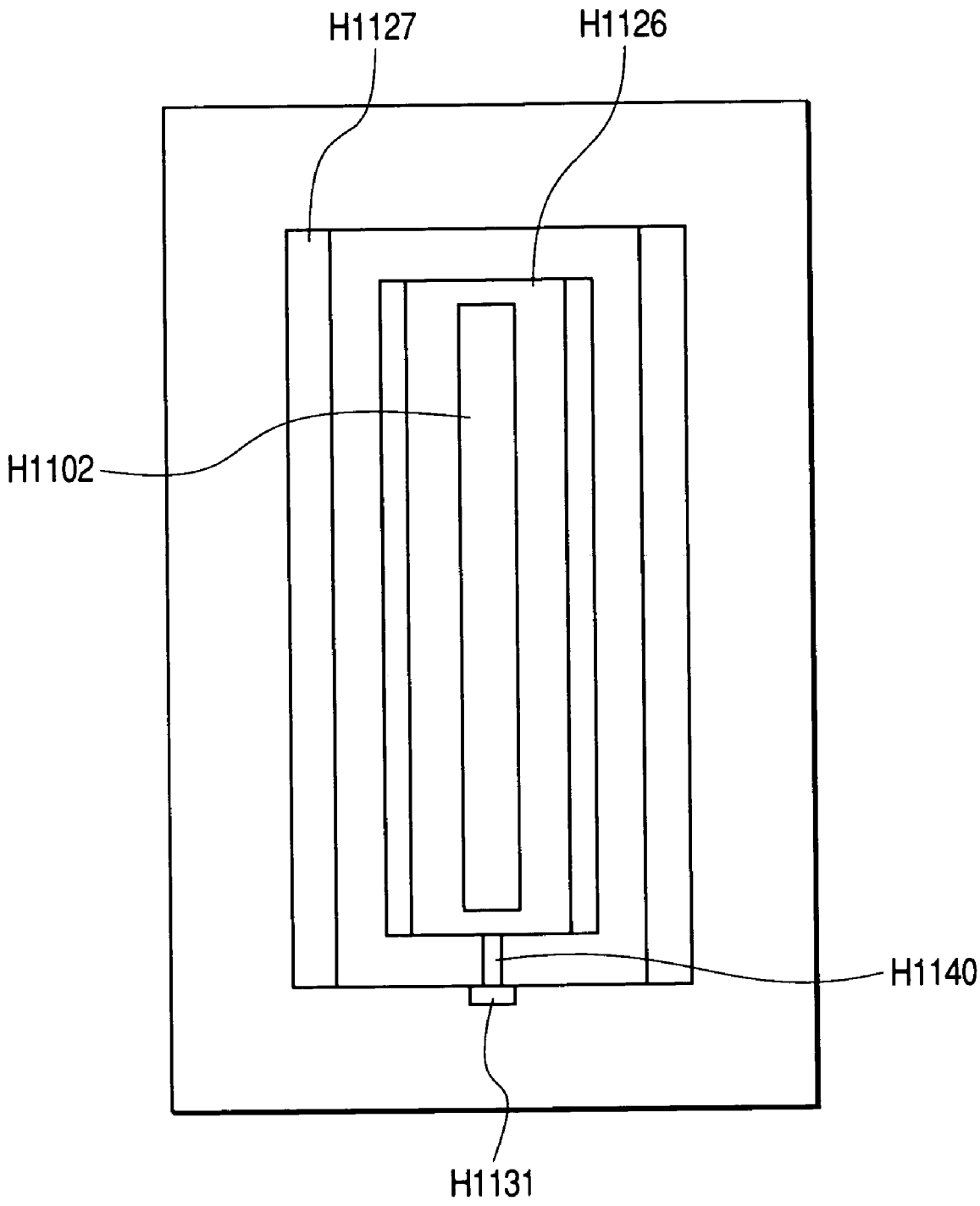
FIG. 14 is a plan view schematically showing the state in which anti-cavitation films are formed on the first recording element substrate according to the first embodiment.

As shown in FIG. 12 the first recording element substrate H1100 includes, arranged on a Si substrate H1110, electrothermal energy conversion elements H1103, transistors (electrical circuit elements) H1121 formed through a layer film H1125 (FIG. 13), wirings H1120 for connecting them, shift registers H1122, decoders H1123 and electrodes H1104. As shown in FIG. 13, a protective film H1124 of $SiO_2$ or the like is formed over the entire surface. Further, a conductive first anti-cavitation film (recording element protecting section) H1126 of Ta is formed at a position above the electrothermal energy conversion elements H1103, and so is a conductive second anti-cavitation film (electrical circuit element protecting section) H1127 at a position above the transistor H1121, each in the rectangular shape as shown in FIG. 14. Above this assembly, a synthetic resin layer is formed. The discharge port H1107 and the flow path H1103 are formed by photolithography. A notch H1128 is formed above the transistor H1121, thereby configuring a discharge port forming member H1129. Above the electrothermal energy conversion element H1103, there is a flow path H1130 for containing the ink. Since this part is liable to develop a high temperature, the protection from the damage due to a cavitation is required. Also, the transistor H1121 is required to have an ink resistance and at the same time to be protected especially from the thermal effect. For this purpose, the two anti-cavitation films H1126, H1127 are formed to cover the two portions described above. Also, an anti-cavitation film wiring H1140 for electrically connecting the first anti-cavitation film H1126 and the second anti-cavitation film H1127 to each other is arranged inside the rectangle of the second anti-cavitation film H1127. An inspection electrode pad H1131 is arranged outside the rectangle of the second anti-cavitation film H1127. The inspection electrode pad H1131 is preferably arranged in an area distant from the discharge ports H1107 as shown in FIG. 14 to avoid the effect on the adhesion between the substrate H1110 and the discharge port forming member H1129.

With this configuration, the damage due to the cavitation and the effect of heat at the parts formed with the electrothermal energy conversion elements H1103 and the transistors H1121 can be avoided by the anti-cavitation films H1126, H1127, while at the same time making it possible to secure a sufficient ink resistance of the parts formed with the transistors.

In view of the fact that the ratio which the anti-cavitation films H1126, H1127 occupy of the interior of the Si substrate H1110 is reduced, as shown in FIG. 13, the discharge port forming member H1129 of synthetic resin is bonded mainly to the protective film H1124 on the substrate H1110. As a result, the discharge port forming member H1129, unlike when it is bonded on Ta of the anti-cavitation films H1126, H1127, is formed with a superior adhesion and a high accuracy free of ink leakage or displacement.

As described above, according to this embodiment, the parts such as the electrothermal energy conversion elements H1103 and the electrical circuit elements H1121 on the first recording element substrate H1110 are protected, while at the same time making it possible to maintain accurate position of the discharge ports H1107 and the flow paths H1130.

Figure 15:
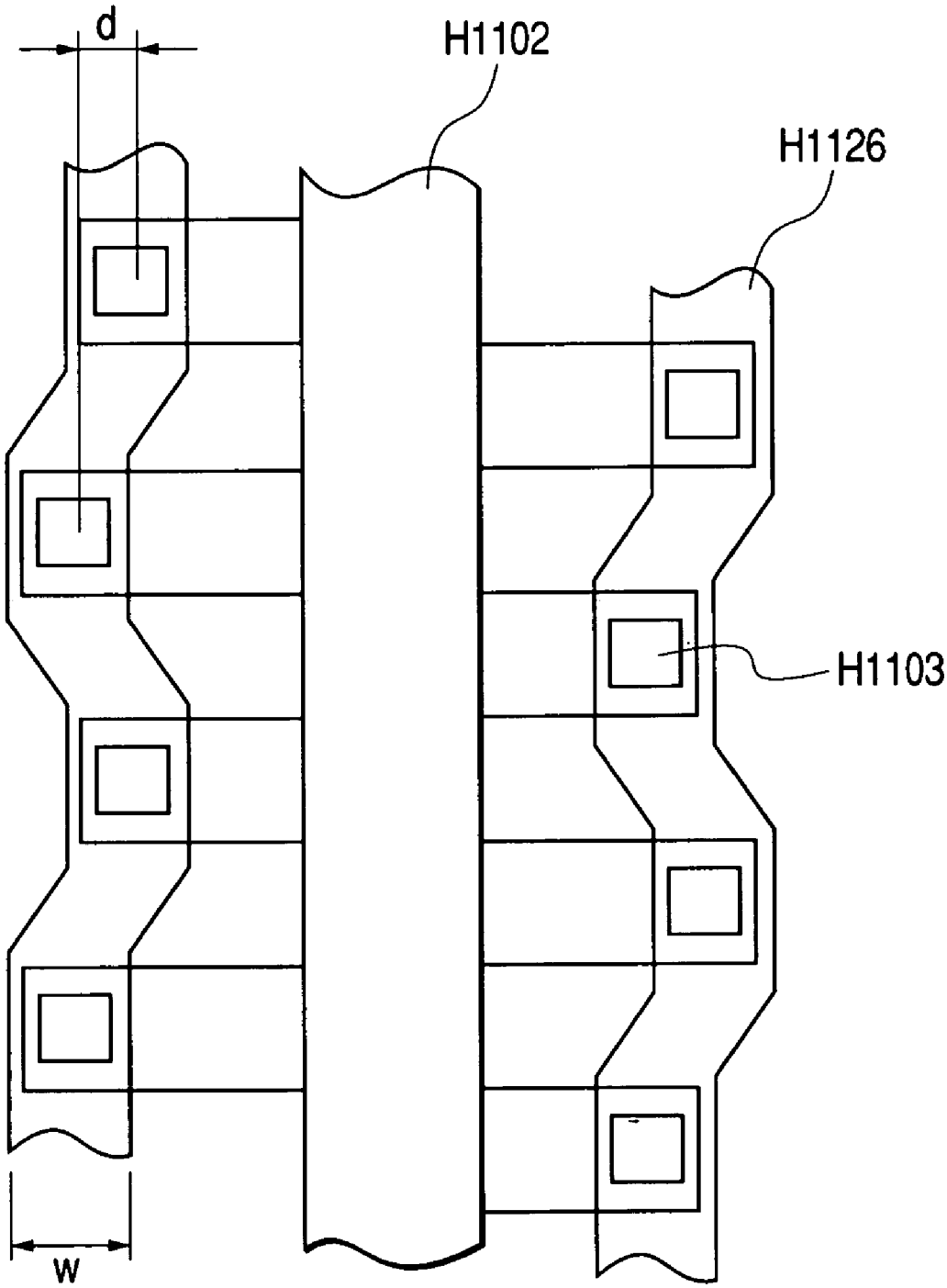
FIG. 15 is a plan view schematically showing the relative positions of the anti-cavitation films and the electrothermal energy conversion elements on the first recording element substrate according to the first embodiment.

According to this embodiment, the first anti-cavitation film H1126 is arranged as shown in FIG. 15, so that the ratio which the first anti-cavitation film H1126 represents of the interior of the substrate H1110 can be further reduced.

Figure 16:
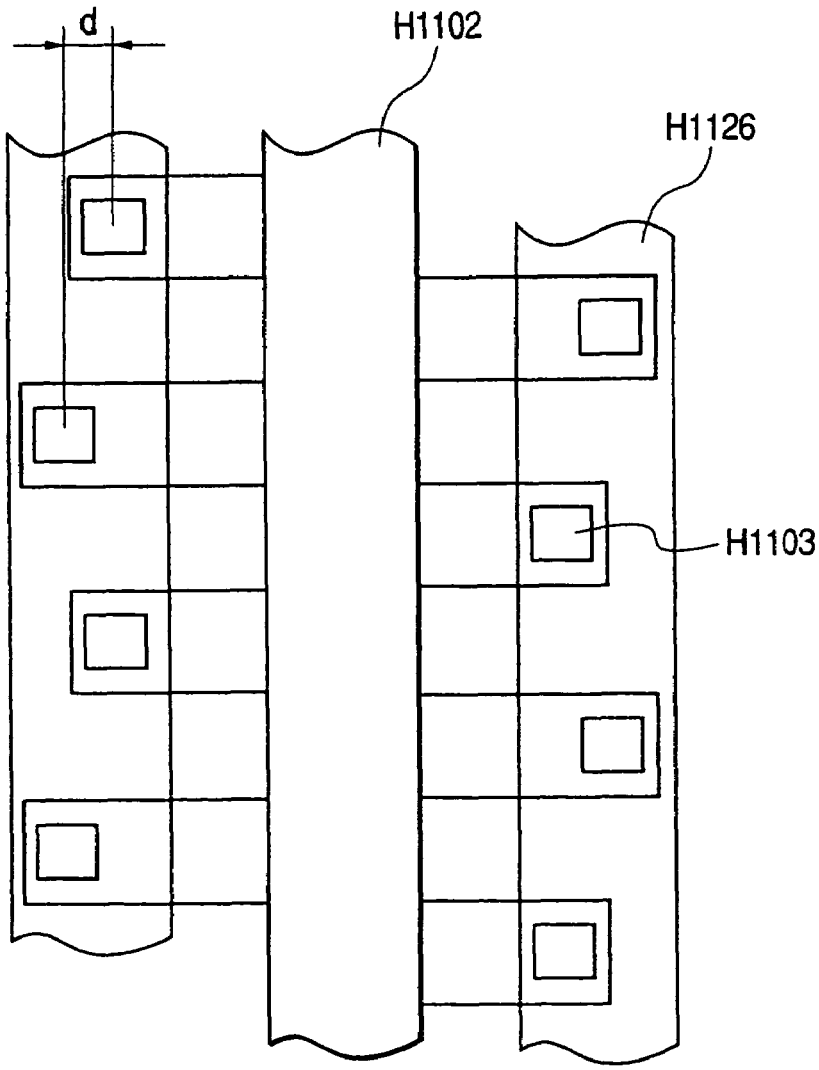
FIG. 16 PRIOR ART
FIG. 16 is a plan view schematically showing the relative positions of the anti-cavitation films and the electrothermal energy conversion elements on the conventional recording element substrate.

With the conventional recording head, as shown in FIG. 16, even when the position of each electrothermal energy conversion element H1103 is displaced longitudinally by d, the first anti-cavitation film H1126 is arranged in parallel to the ink supply ports H1102. As a result, the area of the part covered by the first anti-cavitation film H1126, other than the electrothermal energy conversion elements H1103, is increased, thereby proportionately increasing the ratio which the first anti-cavitation film H1126 represents of the interior of the substrate H1110.

According to this embodiment, by contrast, when the alternate ones of the electrothermal energy conversion elements H1103 are displaced by d as shown in FIG. 15, the first anti-cavitation film H1126 is also arranged displaced by d while maintaining the width w. As a result, the first anti-cavitation film H1126, as compared with the prior art shown in FIG. 16, covers a smaller area of the parts other than the electrothermal energy conversion elements H1103, thereby reducing the ratio which the first anti-cavitation film H1126 represents of the interior of the substrate H1110.

FIGS. 15 and 16 schematically show the relative positions of each electrothermal energy conversion element H1103 and the anti-cavitation film H1126. For the convenience of explanation, however, the actual size relations are not correctly indicated.

According to this embodiment, whether the protective film H1124 under the anti-cavitation films H1126, H1127 is formed free of defects or not can be inspected by utilizing the single inspection electrode pad H1131 arranged on the anti-cavitation film H1127. In a technique employed for this purpose, test probes (not shown) are brought into contact with the inspection electrode pad H1131 to check for the shorting with all the terminals for operating the circuits of the transistors H1121 and the electrothermal energy conversion elements H1103 in the substrate.

When the protective film H1124 is formed free of defects, Ta of the anti-cavitation films H1126, H1127 is insulated from the internal circuits of the substrate by the protective film H1124. In such a case, upon supply of predetermined power from a drive circuit not shown, an appropriate voltage is applied to the electrothermal energy conversion elements H1103, so that the desired heat generation is obtained for discharging the ink.

When the protective film H1124 has a defect, in contrast, Ta of the anti-cavitation films H1126, H1127 and the internal circuits of the substrate are shorted with each other through the defective portion. When the current between the test probes is measured by bringing the test probes into contact with the inspection electrode pad H1131, therefore, the current value obtained is larger than in the absence of defects, so that an abnormality is detected by the measuring person. In this way, when the protective film H1124 has a defect, the internal circuits of the substrate are shorted with the anti-cavitation films H1126, H1127. Even when a predetermined power is supplied from a drive circuit not shown, therefore, no appropriate voltage is applied to the electrothermal energy conversion elements H1103 and no desired heat can be generated for discharging the ink.

As described above, according to this embodiment, the protective film H1124 can be checked for any defect with only one inspection electrode pad H1131 provided for the anti-cavitation films H1126, H127. Thus, the substrate size can be further reduced unlike the configuration of the recording head disclosed in Japanese Patent Application Laid-Open No. 2002-79672, in which the inspection electrode pad H1131 is provided for each of the anti-cavitation films H126, H1127.

A part of the method of fabricating the recording head H1001 according to this embodiment is described briefly.

Figure 17A:
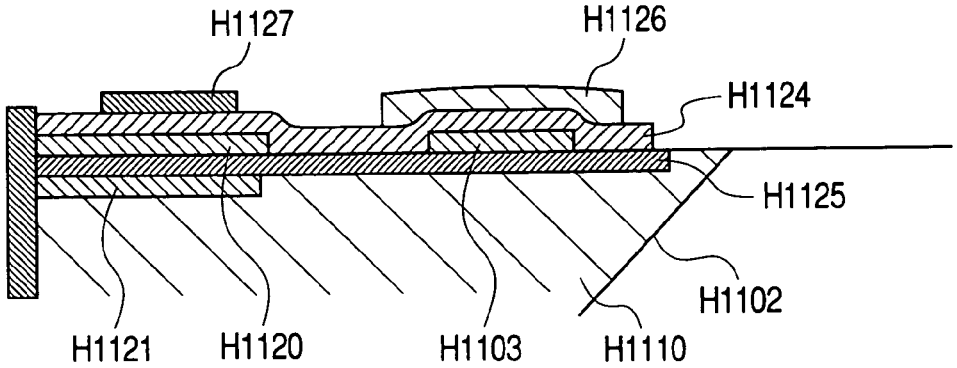
FIGS. 17A, 17B and 17C are sectional views showing a part of the method of fabricating the first recording element substrate according to the first embodiment.
Figure 17B:
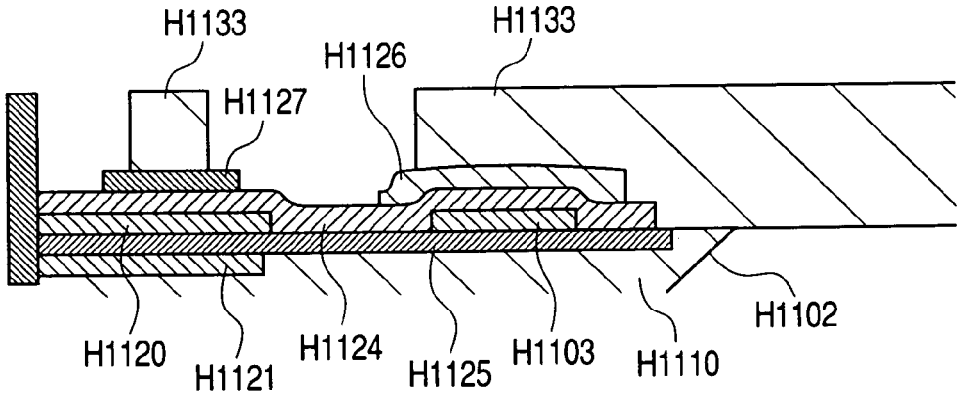
Figure 17C:
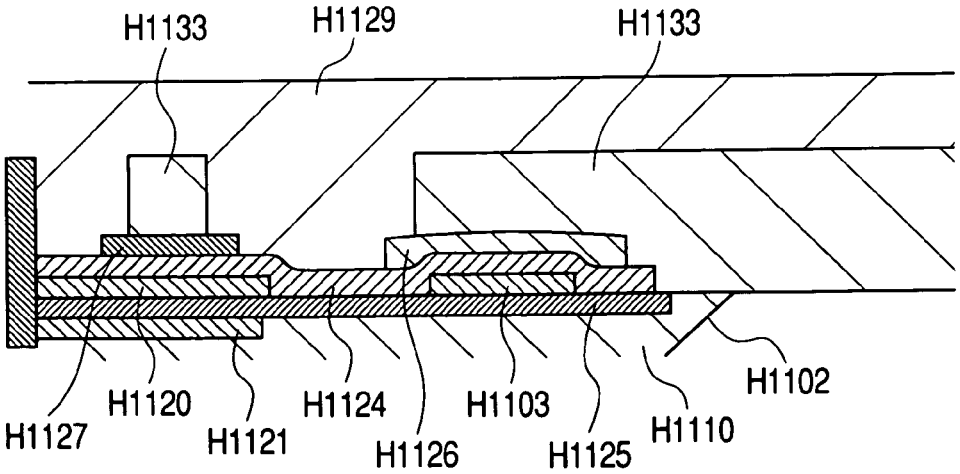

As shown in FIGS. 17A, 17B and 17C, a protective film H1124 of $SiO_2$ or the like is formed while the Si substrate H1110 is formed with the electrothermal energy conversion element H1103, the transistor (electrical circuit element) H1121 and the various wirings H1120. Further, partly on this assembly, the first and second anti-cavitation films H1126, H1127 of Ta are formed. Then, the parts which are later to constitute the flow path H1130 and the notch H1128 are formed each with a model material H1133 forming a resist. Over the entire surface of this assembly, a synthetic resin forming a material of the discharge port forming member H1129 is coated. The model material H1133 is formed at the part which is to become the notch portion H1128 in order to prevent the synthetic resin of the discharge port forming member H1129 from being reduced in thickness at the corner portion of the model material H1133 which is to become the flow path H1130 and thus prevent the deformation of the discharge port forming member H1129. After that, the model material H1133 is removed by melting or the like thereby to form the flow path H1130 and the notch H1128. Further, the end portions of the discharge ports H1107 and the notches H1128 are cut open thereby to complete the discharge port forming member H1129.

The foregoing is the description of the first recording element substrate H1100 having a single supply hole H1102 and a pair of discharge port rows on the two sides of the supply hole H1102. Now, the second recording element substrate H1101 is described with reference to FIG. 18.

According to this embodiment, the second recording element substrate H1101 includes three supply holes H1102 and a total of six rows of discharge ports including one on each of the two sides of each supply hole H1102. While a pair of rectangular anti-cavitation films H1126, H1127 are formed for the first recording element substrate H1100, therefore, the second recording element substrate H1101 is formed with three pairs of rectangular anti-cavitation films H1126, H1127.

Figure 18:
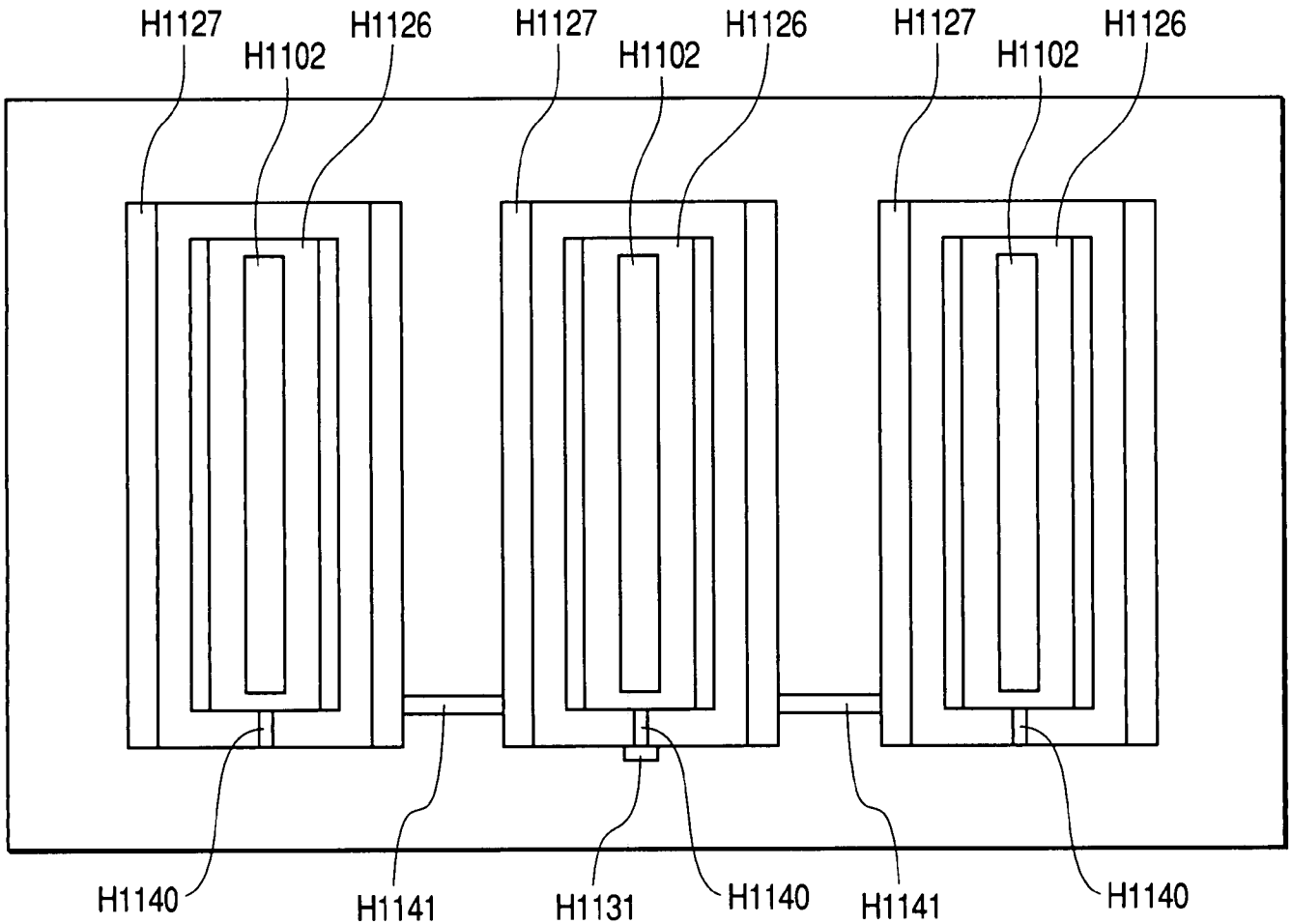
FIG. 18 is a plan view schematically showing the state in which the anti-cavitation films are formed on the second recording element substrate according to the first embodiment.

The first anti-cavitation film H1126 covers the upper part of the electrothermal energy conversion elements H1103, while the second anti-cavitation film H1127 covers the upper part of the transistors (electrical circuit elements) H1121. The three pairs of the anti-cavitation films H1126, H1127 are required to be connected and the inspection electrode pad H1131 is required to be arranged in optimum way from the viewpoints of the adhesion between the substrate H1110 and the discharge port forming member H1129 on the one hand and the space of the inspection electrode pad H1131 on the other. Specifically, a pair of the anti-cavitation films H1126, H1127, like the first recording element substrate H1100, are electrically connected to each other by the anti-cavitation film wiring H1140 inside the rectangle of the second anti-cavitation film H1127. Further, the adjoining ones of the second anti-cavitation films H1127 are electrically connected to each other by the anti-cavitation film wiring H1141. Only one inspection electrode pad H1131, like the first recording element substrate H1100, is provided for the central second anti-cavitation film H1127. This inspection electrode pad H1131 is desirably arranged in an area distant from the discharge ports H1107, as shown in FIG. 18, in order to avoid the effect on the adhesion between the substrate H1110 and the discharge port forming member H1129. Also, the inspection electrode pad H1131 may be arranged only on any one of the three second anti-cavitation films H1127.

As described above, according to this embodiment, also in the case of the second recording element substrate H1101, the protective film H1124 can be checked for any defect with only one inspection electrode pad H1131 provided for the anti-cavitation films H1126, H1127, thereby making it possible to further reduce the size of the substrate.

<Embodiment 2>

A second embodiment of the invention is explained below with reference to FIG. 19. This embodiment is different from the first embodiment only in the configuration of the second recording element substrate H1100, and the other configuration is similar to that of the first embodiment and therefore is not described.

Figure 19:
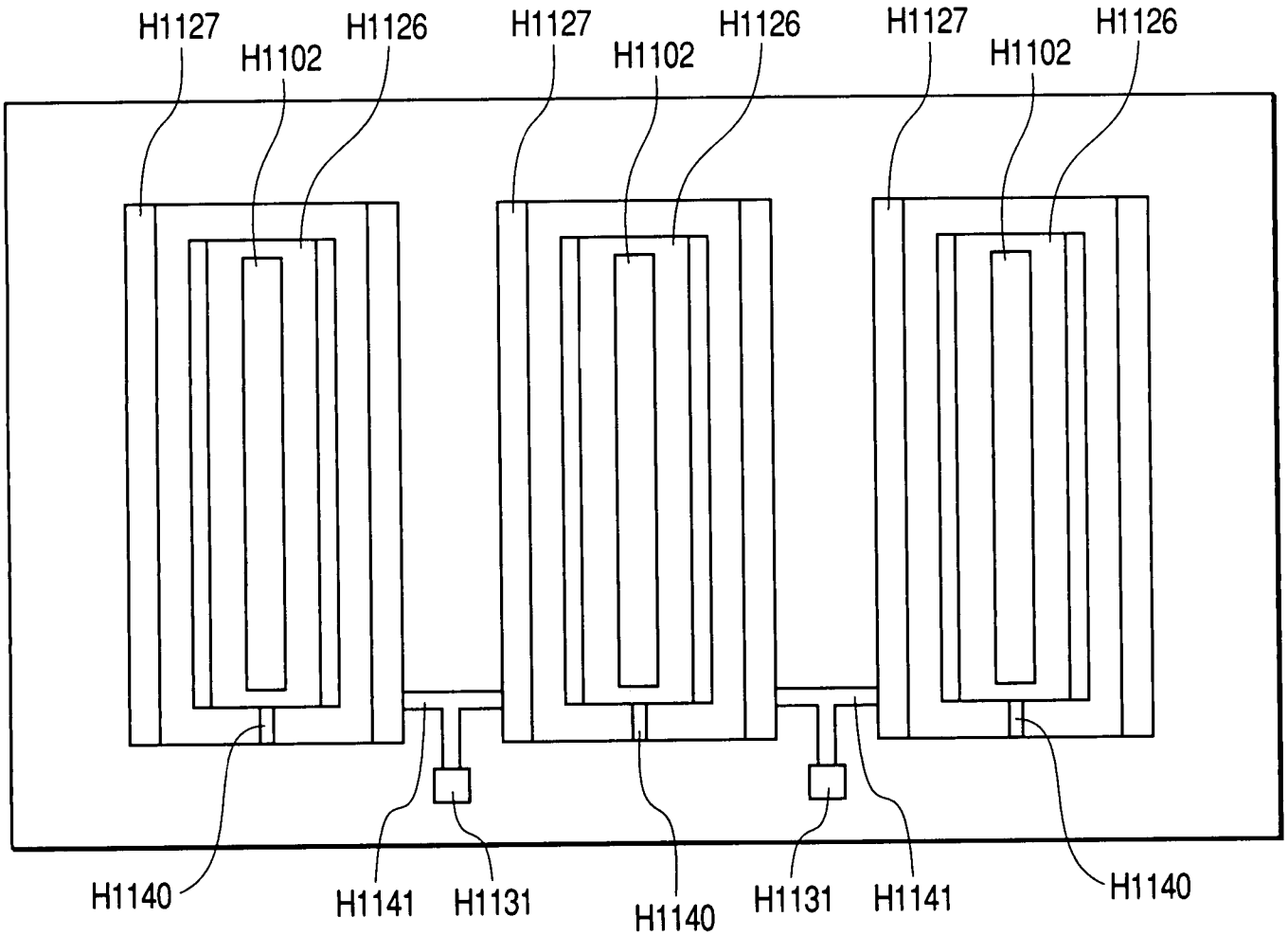
FIG. 19 is a plan view schematically showing the state in which the anti-cavitation films are formed on the second recording element substrate according to a second embodiment of the invention.

FIG. 19 is a diagram showing the second recording element substrate H1101 according to the second embodiment of the invention. In this diagram, the same configuration at the same position as the corresponding one of FIG. 18 is designated by the same reference numerals and is not described.

According to this embodiment, the adjoining ones of the second anti-cavitation films H1127 of the second recording element substrate H1101 are electrically connected to each other by the second anti-cavitation film wiring H1141 (connecting wire). The wiring led out from each of the second anti-cavitation film wirings H1141 is provided with the inspection electrode pads H1131 (two in FIG. 19). The inspection electrode pads H1131 are desirably arranged in an area distant from the discharge ports H1107 to avoid the effect on the adhesion between the substrate H1110 and the discharge port forming member H1129, as shown in FIG. 19.

The wiring led out of the second anti-cavitation film wiring H1141 is considered to have a negligibly small factor for weakening the adhesion between the substrate H1110 and the discharge port forming member H1129. As a result, the number of the inspection electrode pads H1131 can be increased in order to give priority to the detection sensitivity in an area where the inspection electrode pad H1131 arranged on the lead wiring has no effect on the adhesion between the substrate H1110 and the discharge port forming member H1129 and where the substrate size is not increased.

(3) Ink Jet Recording Apparatus

Figure 20:
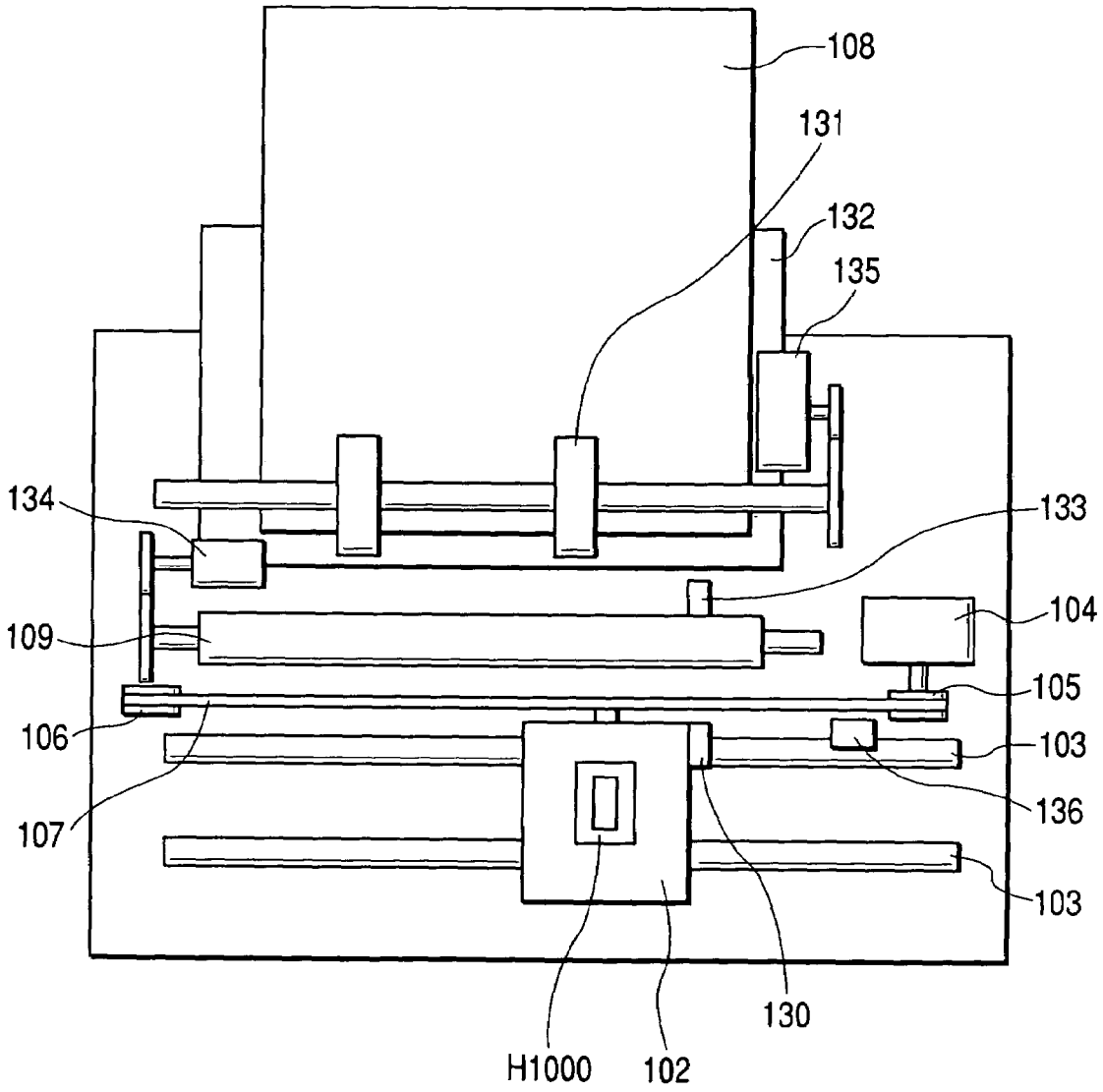
FIG. 20 is a diagram for explaining an example of a recording apparatus on which the recording head according to the invention is mountable.

A recording apparatus on which a recording head H1001 of cartridge type described above can be mounted is explained. FIG. 20 is a diagram for explaining an example of the recording apparatus on which the recording head according to this invention is mountable.

In the recording apparatus shown in FIG. 20, the recording head cartridge H1000 shown in FIGS. 1A and 1B is replaceably mounted in position on the carriage 102. The carriage 102 includes an electrical connecting section for transmitting a drive signal or the like to each discharge port through an external signal input terminal on the recording head cartridge H1000.

The carriage 102 is supported and guided reciprocably along guide shafts 103 arranged extending on the apparatus proper in the main scanning direction. The carriage 102 is driven by a driving mechanism including a main scanning motor 104 through a motor pulley 105, a driven pulley 106 and a timing belt 107, while at the same time being controlled in position and movement. Also, a home position sensor 130 is mounted on the carriage 102. As a result, it is possible to determine the position at which the home position sensor 130 on the carriage 102 passes the masking plate 136.

The recording medium 108 such as the printing papers and the plastic sheets are fed, separately one by one, from an auto sheet feeder (ASF) 132 by rotating pickup rollers 131 by a paper feed motor 135 through a gear. Further, the rotation of a conveyor roller 109 causes the recording medium 108 to be conveyed (auxiliary scanning) through a position (print unit) in opposed relation with the discharge port surface of the recording head cartridge H1000. The conveyor roller 109 is driven by the turning effort of a LF motor 134 through a gear. In the process, it is determined whether the paper has been fed or not and the starting position of paper feed is searched and determined at the time point when the recording medium 108 passes a paper end sensor 133. The paper end sensor 133 is used also for the purpose of determining the actual position of the rear end of the recording medium 108 and finally determining the current recording position from the actual rear end.

The recording medium 108 has the reverse side thereof supported by a platen (not shown) in order to form a flat printed surface at the printing unit. In this case, the recording head cartridge H1000 mounted on the carriage 102 is held in such a manner that the discharge port surface thereof is projected downward of the carriage 102 in parallel to the recording medium 108 between the pair of the conveyor rollers.

The recording head cartridge H1000 is mounted on the carriage 102 in such a manner that the discharge ports of the discharge units are arranged in the direction crossing the scanning direction of the carriage 102. The recording liquid is discharged from these discharge ports for recording.

It will thus be understood from the foregoing description that according to the embodiments of the invention, there are provided a reliable, compact recording head and a recording apparatus using the recording head, in which the adhesion between a compact substrate and a discharge port forming member is improved, while having a sufficient ink resistance and a sufficient anti-cavitation property, and in which the protective film capable of preventing the damage to the circuits in the substrates can be easily inspected for a defect.

What is claimed is:

1. An ink jet recording head comprising:

a substrate;

a plurality of recording elements for generating discharge energy for discharging ink droplets of a recording liquid from at least a discharge port, the recording elements forming a recording element row arranged on the substrate;

a plurality of electrical circuit elements for driving the recording elements, the electrical circuit elements forming an electrical circuit element row arranged adjacent to the recording element row on the substrate;

at least a conductive recording element protecting section for covering an upper part of the recording element row;

at least a conductive electrical circuit element protecting section for covering an upper part of the electrical circuit element row;

at least a conducting section for electrically connecting the conductive recording element protecting section and the conductive electrical circuit element protecting section to each other; and an electrode pad adapted to be electrically connected to the conducting section.

2. An ink jet recording head according to claim 1, wherein the recording element protecting section and the electrical circuit element protecting section are an anti-cavitation film.

3. An ink jet recording head according to claim 1, wherein the recording element protecting section is provided along an ink supply port and at a periphery thereof.

4. An ink jet recording head according to claim 1, wherein the electrical circuit element protecting section is provided at an outer periphery of the recording element protecting section.

5. An ink jet recording head according to claim 1, wherein the recording element protecting section is provided along an ink supply port and at a periphery thereof and the electrical circuit element protecting section is provided at an outer periphery of the recording element protecting section.

6. An ink jet recording apparatus comprising:

an ink jet recording head including a substrate, a plurality of recording elements for generating discharge energy for discharging ink droplets of a recording liquid from at least a discharge port, the recording elements forming a recording element row arranged on the substrate, a plurality of electrical circuit elements for driving the recording elements, the electrical circuit elements forming an electrical circuit element row arranged adjacent to the recording element row on the substrate, at least a conductive recording element protecting section for covering an upper part of the recording element row, at least a conductive electrical circuit element protecting section for covering an upper part of the electrical circuit element row, at least a conducting section for electrically connecting the conductive recording element protecting section and the conductive electrical circuit element protecting section to each other; and an electrode pad adapted to be electrically connected to the conducting section; and electricity supply means for supplying the ink jet recording head with an electrical signal for driving the ink jet recording head.

7. An ink jet recording apparatus according to claim 6, wherein the recording element protecting section and the electrical circuit element protecting section are an anti-cavitation film.

8. An ink jet recording apparatus according to claim 6, wherein the recording element protecting section is provided along an ink supply port and at a periphery thereof.

9. An ink jet recording apparatus according to claim 6, wherein the electrical circuit element protecting section is provided at an outer periphery of the recording element protecting section.

10. An ink jet recording apparatus according to claim 6, wherein the electrode pad is provided at a position electrically conductive to the recording element protecting section and the conducting section, other than the positions of the recording element protecting section and conducting section.

11. An ink jet recording head comprising:

a substrate;

at least a first ink supply port provided on the substrate;

a plurality of recording elements for generating discharge energy for discharging ink droplets of a recording liquid from at least a discharge port, the recording elements forming a first recording element row arranged on each side of the first ink supply port on the substrate;

a plurality of electrical circuit elements for driving the recording elements, the electrical circuit elements forming a first electrical circuit element row arranged outside the first ink supply port with respect to the first recording element row;

at least a conductive first recording element protecting section for covering an upper part of the first recording element row;

at least a conductive first electrical circuit element protecting section electrically connected with the first recording element protecting section for covering an upper part of the first electrical circuit element row;

at least a second ink supply port provided on the substrate;

a plurality of recording elements for generating discharge energy for discharging ink droplets of a recording liquid from at least a discharge port, the recording elements forming a second recording element row arranged on each side of the second ink supply port on the substrate;

a plurality of electrical circuit elements for driving the recording elements, the electrical circuit elements forming a second electrical circuit element row arranged outside the second ink supply port with respect to the second recording element row;

at least a conductive second recording element protecting section for covering an upper part of the second recording element row;

at least a conductive second electrical circuit element protecting section electrically connected with the second recording element protecting section for covering an upper part of the second electrical circuit element row;

at least a conducting section for electrically connecting the first electrical circuit element protecting section and the second electrical circuit element protecting section to each other.

12. An ink jet recording head according to claim 11, wherein the first recording element protecting section, the second recording element protecting section, the first electrical circuit element protecting section and the second electrical circuit element protecting section are an anti-cavitation film.

13. An ink jet recording apparatus comprising:

an ink jet recording head including a substrate, at least a first ink supply port provided on the substrate, a plurality of recording elements for generating discharge energy for discharging ink droplets of a recording liquid from at least a discharge port, the recording elements forming a first recording element row arranged on each side of the first ink supply port, a plurality of electrical circuit elements for driving the recording elements, the electrical circuit elements forming a first electrical circuit element row arranged outside the first ink supply port with respect to the first recording element row, a conductive first recording element protecting section for covering an upper part of the first recording element row, a conductive first electrical circuit element protecting section electrically connected with the first recording element protecting section for covering an upper part of the first electrical circuit element row, at least a second ink supply port provided on the substrate, a plurality of recording elements for generating discharge energy for discharging ink droplets of a recording liquid from at least a discharge port, the recording elements forming a second recording element row arranged on each side of the second ink supply port on the substrate, a plurality of electrical circuit elements for driving the recording elements, the electrical circuit elements forming a second electrical circuit element row arranged outside the second ink supply port with respect to the second recording element row, at least a conductive second recording element protecting section for covering an upper part of the second recording element row, at least a conductive second electrical circuit element protecting section electrically connected with the second recording element protecting section for covering an upper part of the second electrical circuit element row, a conducting section for electrically connecting the first electrical circuit element protecting section and the second electrical circuit element protecting section to each other, and an electrode pad adapted to be electrically connected to the conducting section.

14. An ink jet recording apparatus according to claim 13, wherein the first recording element protecting section, the second recording element protecting section, the first electrical circuit element protecting section and the second electrical circuit element protecting section are an anti-cavitation film.

* * * * *